US007859947B2

(12) United States Patent
Kawai

(10) Patent No.: US 7,859,947 B2
(45) Date of Patent: Dec. 28, 2010

(54) WATCH INFORMATION CONTENT DISTRIBUTION PROCESSING SYSTEM, INFORMATION DISTRIBUTION APPARATUS, INFORMATION DISTRIBUTION SYSTEM, HAND HELD TERMINAL DEVICE, INFORMATION RECORDING MEDIUM, AND INFORMATION PROCESSING METHOD

(75) Inventor: Eiji Kawai, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 12/582,626

(22) Filed: Oct. 20, 2009

(65) Prior Publication Data

US 2010/0039902 A1 Feb. 18, 2010

Related U.S. Application Data

(63) Continuation of application No. 10/020,358, filed on Oct. 30, 2001, now abandoned.

(30) Foreign Application Priority Data

Oct. 31, 2000 (JP) ..... 2000-333120
Aug. 13, 2001 (JP) ..... 2001-245694

(51) Int. Cl.
*G04B 47/00* (2006.01)
*G04C 11/02* (2006.01)
*G09G 5/00* (2006.01)

(52) U.S. Cl. ..... 368/10; 368/47; 368/239; 345/2.3

(58) Field of Classification Search ..... 368/10, 368/46, 47, 82; 375/368, 370, 509, 512; 345/1.2, 2.1, 2.3; 709/217–219
See application file for complete search history.

(56) References Cited

U.S. PATENT DOCUMENTS

| | | | |
|---|---|---|---|
| 2,671,131 | A | 3/1954 | Johnson |
| 5,790,939 | A | 8/1998 | Malcolm et al. |
| 6,385,591 | B1 | 5/2002 | Mankoff |
| 6,449,219 | B1 | 9/2002 | Hepp et al. |
| 6,525,997 | B1 | 2/2003 | Narayanaswami et al. |
| 6,628,974 | B1 | 9/2003 | Lim |
| 6,714,486 | B2 | 3/2004 | Biggs |
| 6,750,830 | B1 | 6/2004 | Teshima et al. |

(Continued)

FOREIGN PATENT DOCUMENTS

DE 14 47 021 10/1938

(Continued)

*Primary Examiner*—Vit W Miska
(74) *Attorney, Agent, or Firm*—Finnegan, Henderson, Farabow, Garrett & Dunner, LLP

(57) ABSTRACT

A system for distributing and information processing watch information contents D1 concerning a variety of clocks, the system comprising: an information distribution device 19 that distributes watch information contents D1 concerning a variety of clocks, the contents being created in advance, as data to an information user's hand held terminal device #i (i=1 to n); and a plurality of hand held terminal devices #i that acquires and processes watch information contents D1 distributed as data by this information distribution device 19, wherein a software watch based on the watch information contents D1 is displayed as a video image, and a time is clocked at the hand held terminal device #i. In this manner, a plurality of software watches with different designs can be configured, and time display of these software watches can be automatically corrected.

24 Claims, 29 Drawing Sheets

U.S. PATENT DOCUMENTS

| | | | |
|---|---|---|---|
| 6,889,246 | B1 | 5/2005 | Kawamoto et al. |
| 2001/0015972 | A1 | 8/2001 | Horiguchi et al. |
| 2002/0150092 | A1 | 10/2002 | Bontempi et al. |
| 2002/0150236 | A1 | 10/2002 | Oshima |
| 2002/0181333 | A1 | 12/2002 | Ito et al. |
| 2002/0184154 | A1 | 12/2002 | Hori et al. |
| 2003/0147367 | A1 | 8/2003 | Pucheu et al. |

FOREIGN PATENT DOCUMENTS

| | | |
|---|---|---|
| EP | 0 539 333 | 4/1993 |

FIG. 7

| NUMBER | CLOCK FRAME INFORMATION D110 | CHARACTER BOARD INFORMATION D111 | INDICATOR SHAPE INFORMATION D112 | CHARACTER BOARD BACKGROUND INFORMATION D113 |
|---|---|---|---|---|
| (1) | | 12 1 2 3 4 5 6 7 8 9 10 11 | | PLAIN |
| (2) | | XII I II III IV V VI VII VIII IX X XI | | LANDSCAPE PICTURE |
| (3) | | | | ANIMAL PICTURE |
| (4) | | | | PLANT PICTURE |
| | | | | |

WATCH INFORMATION CONTENT DISTRIBUTION PROCESSING SYSTEM, INFORMATION DISTRIBUTION APPARATUS, INFORMATION DISTRIBUTION SYSTEM, HAND HELD TERMINAL DEVICE, INFORMATION RECORDING MEDIUM, AND INFORMATION PROCESSING METHOD

CROSS REFERENCE TO RELATED APPLICATIONS

This is a continuation of application Ser. No. 10/020,358, filed Oct. 30, 2001 now abandoned, the contents of which are incorporated herein by reference, which claims priority to Application Nos. JP 2000-333120 filed on Oct. 31, 2000 in Japan and JP 2001-245694 filed on Aug. 13, 2001 in Japan.

BACKGROUND OF THE INVENTION

1. Field of the Invention

The present invention relates to a watch information content distribution processing system, an information distribution apparatus, an information distribution system, a hand held terminal device, an information recording medium, and an information processing method suitably applied to a software watch embodied by a wristwatch, a brand watch, or fashion watch of design specific to an owner.

More particularly, the present invention provides a plurality of hand held terminal devices that processes watch information contents, wherein a software watch is displayed as a video image by the hand held terminal device based on watch information contents, and time is clocked so that a plurality of software watches with different designs can be configured according to the preference of an information user, and a clock display of these software watches can be automatically corrected.

2. Description on Related Art

Conventionally, many people use a wristwatch wearing one's wrist as means for watch a time. In such a circumstance, an increased number of people watch a time through a hand held telephone set recently. One directly wears the wristwatch. Thus, there are many cases in which the watch is removed from one's wrist. In addition, there are many cases in which a leather belt is replaced with a metallic belt for use in the summer time.

In recent years, there has been mainly used a quartz type watch, and a time display error is becoming small. However, in a replacement clock, an electrical device with its clock function, fixed telephone or wristwatch, or a hand held telephone set and the like, an error is gradually stored over a long period of time, and time correction is periodically required. In this case, a user makes a phone call for correct time service, whereby the current time is acquired, and the time correction may be manually performed according to be acquire current time.

In addition, a wristwatch having its superior design properties called a brand watch or a fashion watch is popular, and there is a tendency that one person has a plurality of wristwatches. The owners of watches use a plurality of wristwatches according to its preference.

In the meantime, the following problems occur according to the wristwatch and time adjustment according to a conventional system.

<1> There is a danger that a wristwatch blocks manual work or is damaged because it is directly wound around one's wrist. In particular, one feels discomfort in the summertime because a belt section becomes dirt.

<2> Since a quartz type watch is mainly used, although an error becomes small, such error is accumulated, and must be manually corrected periodically. This time error is manually corrected by making a phone call for correct time service, thereby acquiring the current time, and carrying out time correction based on the acquired current time. However, the current time is voice guidance information. Therefore, one must adjust a respective one of time correction timings to a display time of wristwatch, placement clock or an electronic device with its clock function (hereinafter, referred to a clock device) while listening to a telephone receiver, which is inconvenient.

<3> Many of these clock devices are corrected only every second, and there is an inconvenience that one must wait a maximum of 60 seconds until the indicators has indicated 0 second for time correction of such clock. If a timing is not adjusted well, one must wait 60 seconds until the indicator has indicated 0 second, and one must repeat this waiting, which impairs convenience.

<4> It is basically an arbitrary user who make a phone call for correct time service, thereby carrying out time correction. It is difficult to know how much one's clock has in an arbitrary time. Therefore, it is required for a clock manufacturer or an electronic device manufacturer with a clock function to provide a clock function with a minimally small absolute error. This leads to an increase in cost such as mount of a quartz oscillator with high precision or the like.

<5> In addition, there is a tendency that one owns a plurality of wristwatches such as a brand watch having its superior design properties or a fashion watch, and however, there is an inconvenience that one must own and manage a plurality of wristwatches physically because such wristwatches are hardware.

<6> There is an inconvenience that, if one attempts to use a plurality of these wristwatches according to its preference, one must replace them every time.

<7> Further, if one attempts to own a plurality of wristwatches, the cost is increased.

<8> Furthermore, although only one required clock can be used for a user at the same time, if one attempts to own a plurality of wristwatches, all the wristwatches must contain independent batteries, which is not suitable in global environment from the viewpoint of wasteful battery consumption.

SUMMARY OF THE INVENTION

The present invention has been made in order to solve the foregoing conventional problems. It is an object of the present invention to provide a watch information content distribution processing system, an information distribution apparatus, an information distribution system, a hand held terminal device, an information recording medium, and an information processing method such that a plurality of software watches with different design properties can be configured according to the preference of the information user, and time display of these software watches can be automatically corrected.

In order to solve the foregoing problem, according to the present invention, there is provided: A system of distributing watch information contents concerning a variety of clocks, and processing information, said system comprising:

an information distribution apparatus that distribute watch information contents concerning said a variety of prepared clocks as data to an information user's hand held terminal device; and a plurality of hand held terminal devices that acquires and processes time information contents distributed as data by means of the information distribution apparatus, wherein a software watch is displayed as a video image based on the watch information contents by the hand held terminal device to clock a time.

According to a first aspect of the present invention, in the case where watch information contents concerning a variety of clocks are distributed, and is information processed, the watch information contents concerning a variety of clocks that has been created in advance are distributed as data from an information distribution apparatus to an information user's hand held terminal device. In the hand held terminal device, the time information contents distributed as data is acquired, a software watch is displayed as a video image based on the watch information contents, and a time is clocked.

Therefore, a plurality of software watches with different designs according to the preference of the information user can be configured. Moreover, in the case where one uses the software watches, one can eliminate physical replacement such as a real wristwatch of a conventional system or does not wear a real wristwatch around one's wrist directly unlike a conventional system. Thus, the wristwatch does not block manual work, is not damaged, or one does not feel discomfort caused by sweat.

An information distribution apparatus according to the present invention is directed to an apparatus for distributing watch information contents concerning a variety of clocks to an information user, comprising:

a data insert section that constructs the watch information contents in a group of data rows, thereby inserting the contents into a carrier signal; and a transmission section that transmits the carrier signal whose data rows are constructed and inserted by the data insert section to the information user's hand held terminal device.

According to an information distribution apparatus of the present invention, for example, in the case where time information contents concerning a variety of clocks are distributed as data by using an existing broadcast infrastructure, watch information contents are constructed in a group of data rows, and is inserted into a carrier signal by means of the data insert section. The watch information contents are multiply transmitted during a vertical blanking period of a television broadcast signal (carrier signal) employed in a broadcast infrastructure. The television broadcast signal whose data rows are constructed and inserted by the data insert section is transmitted from the transmission section to the user's hand held terminal device.

Conventionally, in the information user's hand held terminal device, a group of data rows is received in batch in a predetermined period, and such group can be stored in batch in a storage device. In this manner, after receiving the watch information content, the information user can configure a software watch such as a brand watch or a fashion watch by freely reading out the watch information contents concerning a variety of clocks by a hand held terminal device in unreal time (asynchronous) manner. Hereinafter, the unreal time denotes that provision of information to the information user and use of information by the information user are not carried out at the same time.

The hand held terminal device according to the first aspect of the present invention is directed to an apparatus for acquiring and processing watch information content concerning a variety of clocks, wherein the watch information contents are received and stored, the watch information contents are read out in an asynchronous manner according to information operation of the information user, and at least a software watch is displayed as a video image based on the watch information contents.

In a hand held terminal device according to the first aspect of the present invention, in the case where watch information contents concerning a variety of clocks are acquired, and are processed, for example, if these watch information contents are distributed as data by using the existing broadcast infrastructure, the watch information contents are received and stored in the hand held terminal device, watch information contents are read out in an asynchronous manner according to information operation of the information user, and at least software watch is displayed as a video image based on the watch information contents.

Therefore, after receiving the watch information contents, the information user can configure a software watch such as a brand watch or fashion watch by freely combining watch information contents concerning a variety of cocks in an unreal time (asynchronous) manner. Moreover, the information user can select one software watch from among many types by means of simple information operation. Thus, the user can use a preferable software watch according to the time, the place and the occasion, and can enjoy the software watch freely according to the preference.

An information recording medium according to the present invention is characterized in that watch information contents containing video image information on a plurality of clock character board and time display software; and a software watch based on the watch information contents are displayed as a video image, and a control procedure for clocking a time is described.

According to the information recording medium of the present invention, the watch information contents and control procedure can be sold by using the existing sales infrastructure as package media. Moreover, an information recording medium is mounted on a hand held terminal device on the information user side, and a software watch such as a brand watch or a fashion watch can be constructed by freely combining the watch information contents concerning a variety of clocks in an unreal time (asynchronous) manner.

The information processing method according to the first aspect of the present invention is directed to a method for electronically processing watch information contents concerning a variety of clocks, wherein watch information contents concerning a variety of clocks are created on the information provider side, the watch information contents are distributed as data on the information user's hand held device, a software watch is displayed as a video image based on the watch information contents distributed as data, and a time is clocked.

In the information processing method according to the first aspect of the present invention, when watch information contents concerning a variety of clocks are processed, a plurality of software watches with different designs can be used according to the preference of the information user. Moreover, in the case where one uses a software watch, one can eliminate physical replacement of a real watch or the like in the conventional system or does not wear the real watch around one's wrist as compared with the conventional system. Thus, the wristwatch does not block manual work, is not damaged, or one does not feel discomfort caused by sweat.

A watch information content distribution processing system according to a second aspect of the present invention is directed to a system for distributing current time information concerning a software watch, thereby processing information, the system comprising:

an information distribution system for managing current time information and distributing at least correction startup information and current time information as data according to the information user's request; and a hand held terminal device with a communication function that triggers correction startup information distributed as data from the information distribution system, starts the time correction program and corrects a time of the software watch based on current time information.

In a watch information content distribution processing system according to a second aspect of the present invention, in the case where current time information concerning a software watch is distributed, and is information processed, a time of a software watch can be precisely adjusted to a reference time or the like automatically. Therefore, convenience of the software watch is improved more remarkably.

An information distribution system according to the present invention is directed to a system for distributing at least correction startup information and current time information as data according to the information user's request, the system comprising:

a clock correction/management device that manages current watch information; and wireless communication means for distributing correction startup information and current time information outputted from a time correction/management device according to the request as data to the information user's hand held terminal device.

In the information distribution system according to the present invention, time correction operation can be carried out by the information user at an arbitrary timing, and thus, the time of the software watch is precisely adjusted to a reference clock or the like automatically by means of a very simple operation.

Therefore, in the case of constructing a watch information content distribution processing system, a reference clock device with its high precision may be mounted on a clock correction/management device, and there is no need to provide the clock devices at individual hand held terminal devices. This improves the convenience of the software watch is improved more remarkably or greatly contributes to reduction of a manufacturing cost in a hand held terminal device for handing the software watch.

A hand held terminal device according to a second aspect of the present invention is directed to a hand held terminal device with a communication function that acquires and processed watch information contents concerning a software watch, wherein a communication request is made to a specific communication provider, correction startup information and current time information are received from the communication provider, correction startup information is triggered, a time correction program is started up, and the time of the software watch is corrected based on the current time information.

In the hand held terminal device according to the second aspect of the present invention, a time correcting operation can be carried out at an arbitrary timing, and thus, the time of the software watch can be precisely adjusted automatically to a reference time or the like by means of a very simple operation. Therefore, the convenience of the software watch is improved more remarkably.

Moreover, when a full auto time correction mode is set, if a power is turned ON, time correction itself is not taken consideration into, and the convenience is further improved. In addition, an intermittent auto time correction mode is set, whereby one can recognize a maximum error itself of the software watch, and the maximum error can be kept in advance to be within a predetermined quantity. Thus, one can feel easiness. In addition, there is no need to mount a reference clock device with its high precision, making it possible to reduce a manufacturing cost of a hand held terminal device that handles the software watch.

An information processing method according to the second aspect of the present invention is directed to a method for information processing the current time information concerning a software watch, wherein the information provider manages the current time information and distributes at least correction startup information and current time information as data to the information user's hand held terminal device according to the information user's request, and wherein the information user triggers the correction startup information distributed as data, starts the time correction program and corrects the time of the software watch based on the current time information.

In the information processing method according to the second aspect of the present invention, when the current time concerning the software watch is information processed, the time of the software watch can be precisely adjusted automatically to a reference time or the like. Therefore, the convenience of the software watch is improved more remarkably.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principle of the present invention.

FIG. 7 is an imaginary view showing an example of the watch information content;

DETAILED DESCRIPTION OF THE INVENTION

Figure 1:
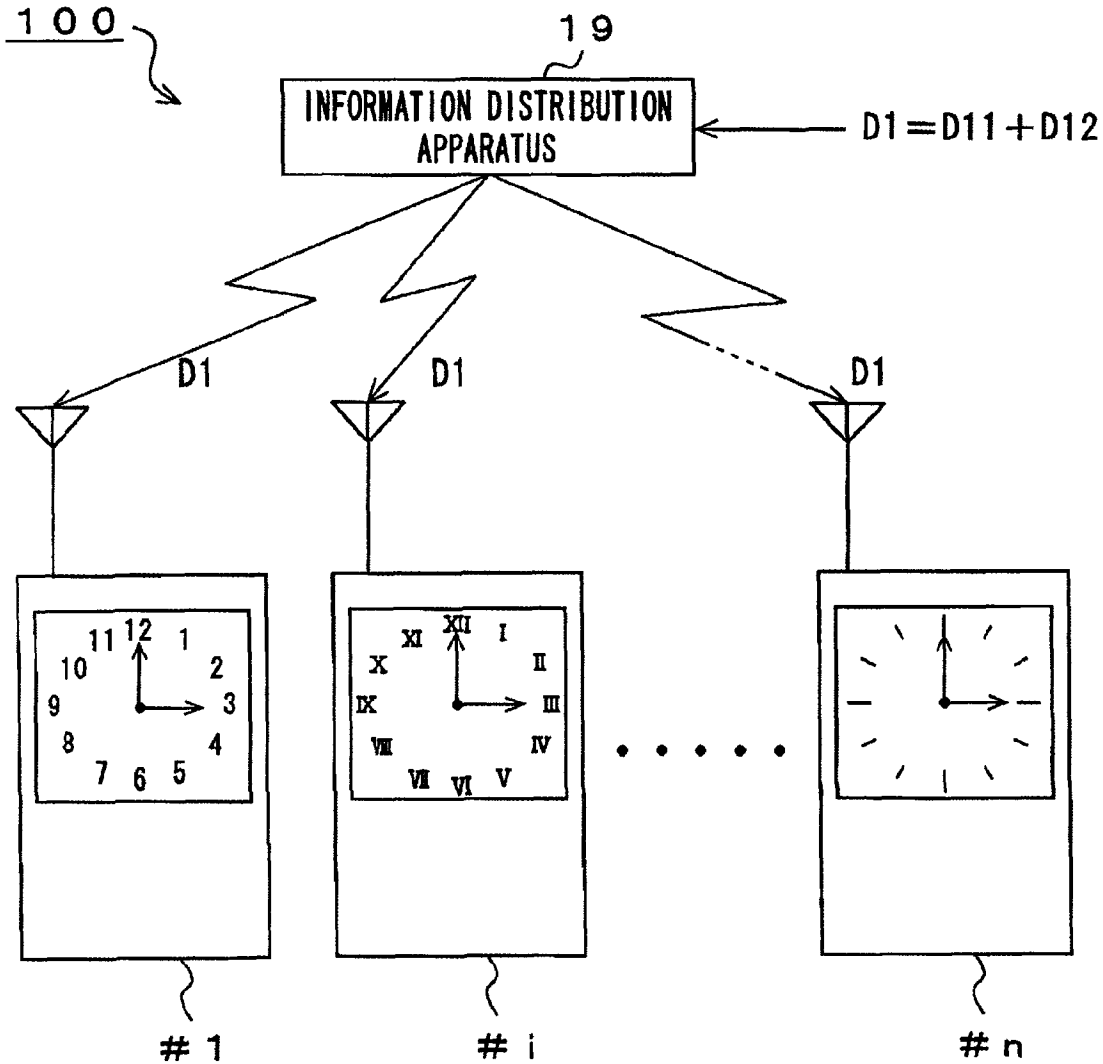
FIG. 1 is a block diagram depicting an exemplary configuration of a watch information content distribution processing system 100 according to a first embodiment of the present invention.

Reference will now be made in detail to the presently preferred embodiments of the invention as illustrated in the accompanying drawings, in which like reference numerals designate like or corresponding parts.

Hereinafter, one preferred embodiment of a watch information content distribution processing system, an information distribution apparatus, an information distribution system, a hand held terminal device, an information recording medium, and an information processing method according to the present invention will be described with reference to the accompanying drawings.

(1) First Embodiment

FIG. 1 is a block diagram depicting an exemplary configuration of a watch information content distribution processing system 100 according to a first embodiment of the present invention.

In the present embodiment, a plurality of hand held terminal devices for acquiring and processing watch information contents to be distributed as data is provided, a software watch is displayed as a video image based on watch information contents by means of the hand held terminal device, and a time is clocked so that a plurality of software watches with different designs can be configured according to the information user's preference. In addition, in the case where these software watches are used, physical replacement such as a real wristwatch of the conventional system can be eliminated.

The watch information content distribution processing system 100 shown in FIG. 1 is directed to a system for distributing watch information content D1 concerning a variety of clocks, thereby processing information. In this system 100, an information distribution apparatus 19 is prepared so as to distribute watch information content D1 concerning a variety of clocks that has been created in advance to the information user's hand held terminal #i (i=1 to n). In this system 100, the existing broadcast infrastructure is used so as to distribute the watch information content D1 to the hand held terminal device #i.

With this broadcast infrastructure, an analog ground wave TV, a digital ground wave TV, a satellite information broadcast, an FM multiple broadcast, and a pager or the like may be provided. Of course, the watch information contents D1 may be distributed individually by using the communication infrastructure without being limited to the broadcast infrastructure. With a communication infrastructure, a fixed telephone network, a wireless communication infrastructure such as a hand held telephone network, or Internet may be provided. This is because a plurality of information users can use the system 100.

In this system 100, plural types of analog watch information content D1 or digital watch information content D1 is distributed as data in batch. This is because the information user freely select these watch information contents D1 so that the user specified software watch can be constructed. The watch information content D1 contains at least video image information concerning clock display such as clock character board (hereinafter, referred to as clock display information D11) and clock display software (hereinafter, referred to as clock display data D12).

On the other hand, specific hand held terminal device #i is prepared by each information user so as to acquire and process watch information content D1 distributed as data by means of an information distribution apparatus 19. In the hand held terminal device #i, a software watch is displayed as a video image based on the watch information content D1, and a time is clocked. In the hand held terminal device #i, there is used a tuner incorporated hand held telephone set or a hand held game device mounted, and then, hand held on the tuner device only when the watch information content D1 is downloaded.

In this system 100, the watch information content D1 is recorded in an information recording medium (not shown), and is provided to an information user without being limited to data distribution caused by a broadcast or communication infrastructure so that the information user may use this information recording medium to be mounted on a hand held terminal device #i. The information recording medium is provided so as to be sold by using the existing sales infrastructure.

In an information recording medium, watch information contents D1 containing plural types of clock display information D11 and time display data D12 or the software watch based on the watch information content D1 is displayed as a video image, and a control procedure for clocking a time or the like is described. A memory card, CD-ROM or the like is used for an information recording medium. In this system 100, plural types of watch information contents D1 and digital watch information content D1 are distributed as data in one package.

In this system 100, watch information content D1 is associated with watch information that has been already managed by a hand held terminal device #i. This is because the software watch based on the watch information content D1 is operated based on the watch information managed by the hand held terminal device #i.

In addition, time information that is a reference from an information provider to an information user's hand held terminal device #i is distributed as data so that the information user corrects watch information managed by the hand held terminal device #i based on time information defined as a reference. In this manner, a time error can be corrected automatically or by simple operation, and thus, an error of the software watch or the like may not be taken consideration into.

In addition, in distributing time information, arbitrary advertisement information and associated additional information are distributed at the same time so as to display associated additional information at a part of a watch screen managed by a hand held terminal #i. The associated additional information is watch information contents D1 distributed as data or to be on sales. Thus the associated additional information can be used as new advertisement media or information media.

In this system 100, watch information contents D1 are distributed by a regular or irregular period by using a broadcast infrastructure from the information provider to the information user's hand held terminal device #i so as to automatically update a design on a watch screen according to a software watch in the hand held terminal device #i by the regular or irregular period. For example, the regular period used here denotes a half day, everyday, several days, every week or every month. The irregular period denotes that a limited period design of such as summer vacation or Christmas or the like is provided to the period. In this manner, the information user himself or herself can enjoy software watches with different designs without such update.

In addition, a video image based on time display information adapted to the season may be automatically displayed by watch information content D1 incorporated in the hand held terminal device #i. Of course, a video image based on watch display information adapted to the time interval may be automatically displayed without being limited to the season. In this manner, a time sense or a season sense can be provided in an operation mode for automatically changing watch information content D1.

Figure 2:
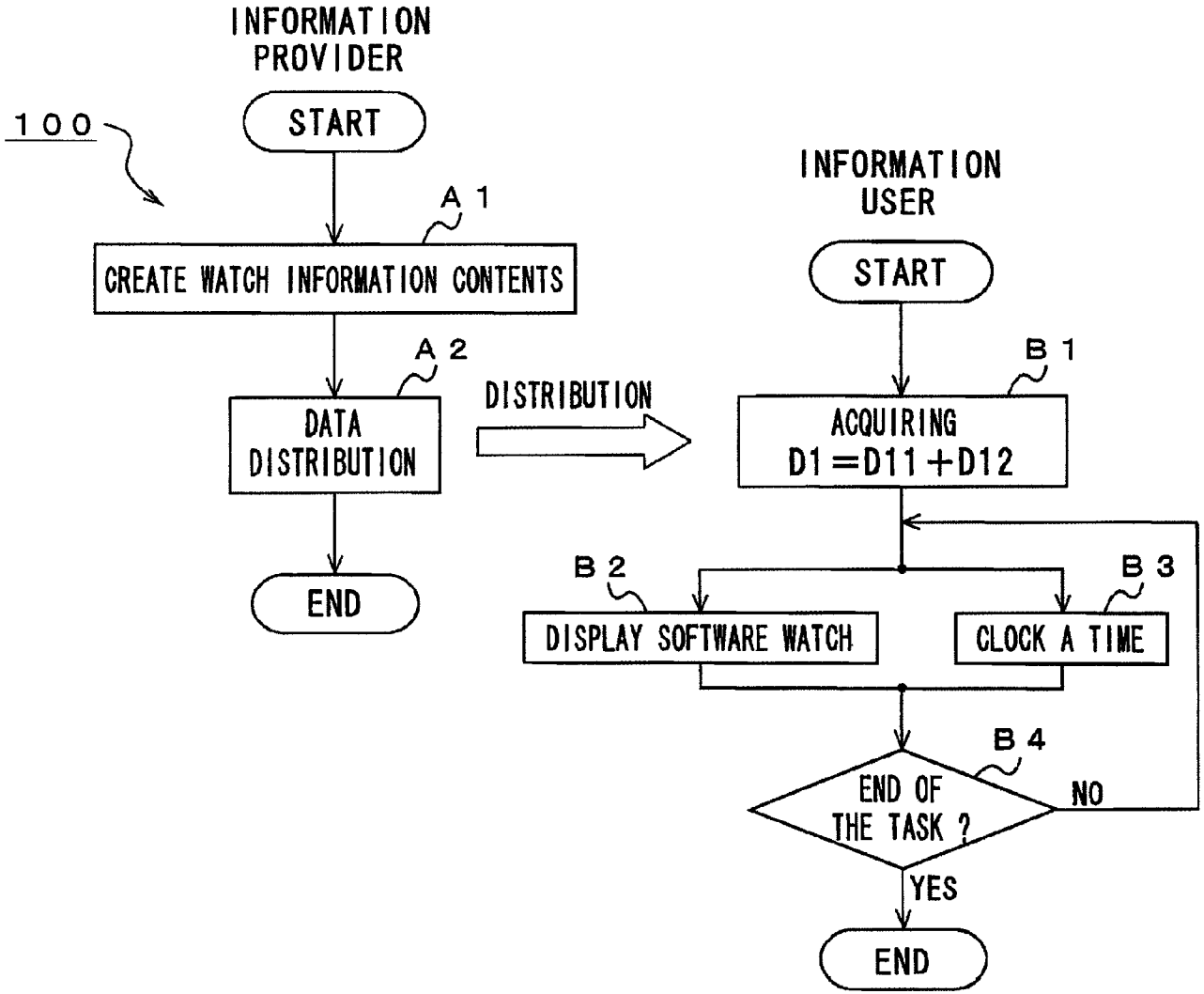
FIG. 2 is a flow chart showing a processing example of the watch information content distribution processing system 100.

Now, an example of information processing in the watch information content distribution processing system 100 will be described here. FIG. 2 is a flow chart showing a processing example of the watch information content distribution processing system 100.

In the present embodiment, assume that, in the case where the watch information content D1 concerning a variety of watches are electronically processed, data is distributed to the information user's hand held terminal device by using the existing broadcast infrastructure or communication infrastructure.

With this being presumed, watch information contents D1 concerning a variety of watches are created by the information provider at the step A1 in the flow chart shown in FIG. 2. Here, plural types of analog or digital watch information contents D1 containing watch display information D11 and time display data D12 are created by the information provider.

In addition, at the step A2 these watch information contents D1 are distributed as data in the information user's hand held terminal device #i. For data distribution, the information distribution apparatus 19 is prepared for a broadcast station in advance, and data is broadcast by using the information distribution apparatus 19. Of course, data may be distributed individually to the information user's hand held terminal device by using the existing communication infrastructure.

The information user acquires watch information contents D1 distributed as data at the step B1. Here, at the information user, for example a tuner device is prepared, a hand held terminal device is set to this tuner device, and the watch information content D1 is downloaded. In addition, at the step B2, the information user displays a software watch as a video image based on the watch information contents D1.

In displaying this video image, the information user selects either of analog type or digital type from among these watch information contents D1 so as to create a user specific software watch by freely combining items of watch display information D11 with each other or the like. This is because a software watch of arbitrary brand watch or fashion watch design is constructed. In addition, at the step B3, a time is clocked by a software watch based on the watch display data D12.

In this way, in the watch information content distribution processing system 100 according to the first embodiment of the present invention, in the case where watch information contents D1 concerning a variety of clock are distributed, and is information processed, a plurality of software watches with different designs can be configured according to the preference of the information user.

Moreover, in the case of using these software watches, physical replacement like a real wristwatch of a conventional system can be eliminated or one does not wear such real watch directly as compared with the conventional system. Thus, the software watch does not block manual work or is not damaged, and one does not feel discomfort caused by sweat.

FIRST EXAMPLE

Figure 3:
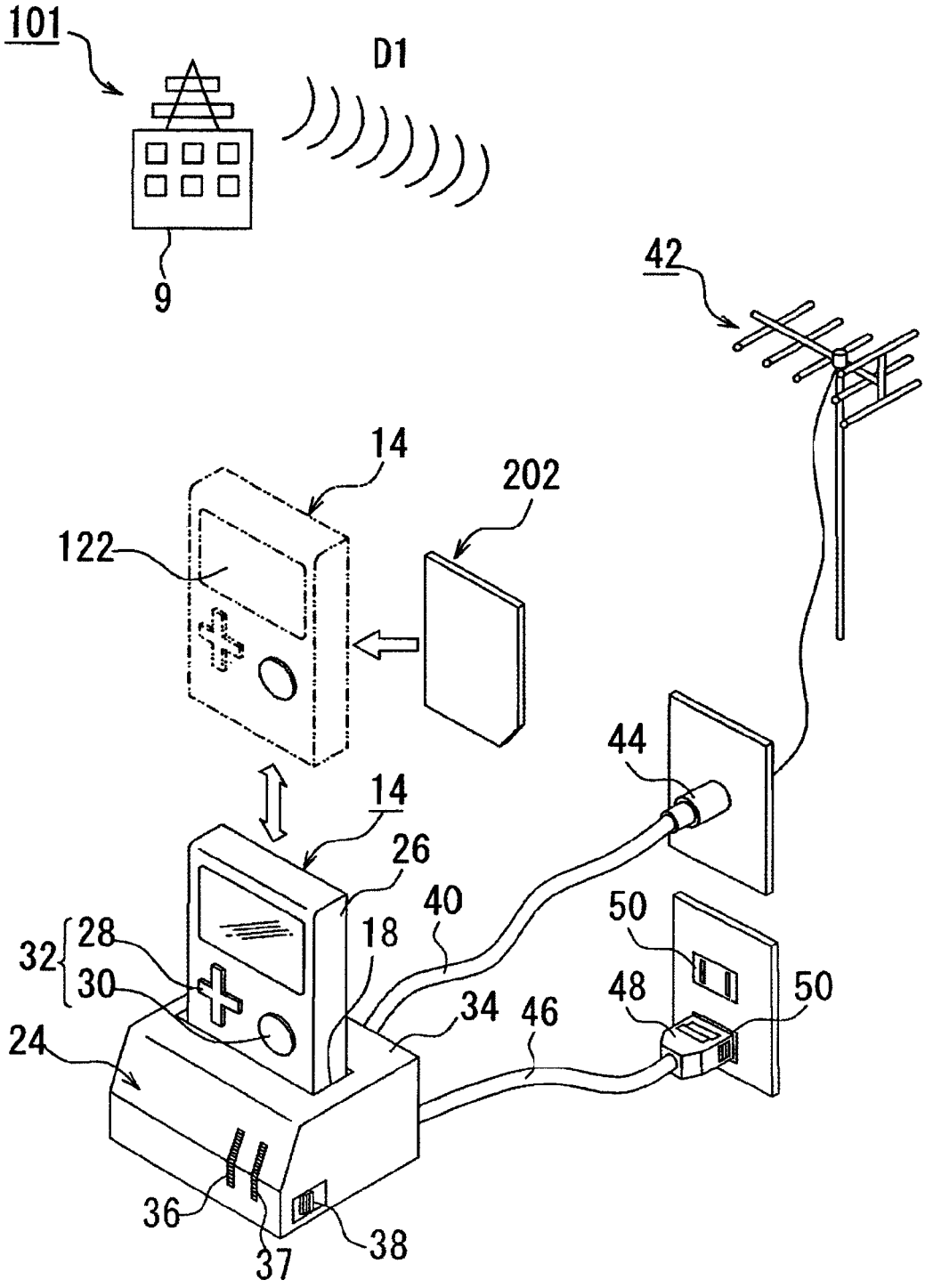
FIG. 3 is an imaginary view showing an exemplary configuration of a software watch system 101 according to the first example of the present invention.

FIG. 3 is an imaginary view showing an exemplary configuration of a software watch system 101 according to a first example of the present invention.

In this example, there is provided a plurality of hand held terminal devices 14 that acquires and processes watch information contents D1 distributed as data. The hand held terminal device 14 displays a software watch based on time information contents D1 on a liquid crystal display screen, and clocks a time. In addition, a plurality of software watches with different designs can be configured according to the preference of the information user. Further, in the case where a software watch is used, physical replacement such as a real wristwatch or the like of the conventional system can be eliminated.

A software watch system 101 shown in FIG. 3 is directed to a system for electronically processing watch information contents D1 concerning an analog software watch or digital software watch, for example. In this system 101, watch information contents D1 is distributed as data from a broadcast station 9 to a hand held terminal device 14 or the like.

This hand held terminal device 14 is directed to a device for acquiring and processing watch information contents D1 concerning a variety of watches. This device receives and stores watch information contents D1, reads out the watch information contents D1 in an asynchronous manner according to the information user's information operation, and displays a software watch as a video image based on at least the watch information contents D1.

The watch information contents D1 are prepared by the information provider, and contain clock display information D11 concerning clock display and clock display data D12 that is clock display software. Further, the clock display information D11 contains: clock frame information D110 of these software watches; character board information (referred to as three-dimensional character board graphics data) D111; long indicator, short indicator, and second indicator shape information D112; and character board background information D113 or the like. The watch information contents D1 are provided as data in advance so as to enable video image display. Time indicating sound such as bell sound of famous temple may be distributed as audio information together (hereinafter, referred to as PCM sound data D15).

In this example, specific program information D2 is contained in watch information contents D1. Here, the program information D2 may be stored in advance in the users hand held terminal device without being distributed as watch information contents D1. This program information D2 is used for freely reconstructing clock display information D11 or time display data D12 or clock frame information D 110, character board information D111, long indicator, short indicator, and second indicator shape information D112, or character board background information D113 and the like and creating a user specific software watch.

On the other hand, each information user prepares a hand held terminal device 14 so that watch information contents D1 containing program information D2 or the like distributed as data from the broadcast station 9 is received by the tuner device 24, the received contents are downloaded on the hand held terminal device 14, and the downloaded contents are recorded and reproduced by the hand held terminal device 14. The hand held terminal device 14 displays watch information contents D1 as a video image or outputs an indicating sound as an audio. This program information D2 consists of the control procedures when a variety of watch information contents D1 are read out on a liquid crystal display monitor (display section) 122 of the hand held terminal device 14 or when a user specific software watch is created. A TFT type liquid crystal display device with high resolution is used for the liquid crystal display monitor 122 while it is small.

In this example, there are provided a tuner device 24 with a charging function shown in FIG. 3 and a specific hand held terminal device 14 that is removably mounted on this tuner device 24 so as to process watch information contents D1 from the broadcast station 9 and game data from a memory card 202. One can enjoy application such as game any time and anywhere. This system 101 receives and stores watch information contents D1 in the tuner device 24.

The watch information contents D1 are provided to an information user by using the existing sales infrastructure in the form of a memory card 202 shown as an example of an information recording medium without being limited to data distribution. Watch information contents D1 concerning a software watch are recorded in the memory card 202, and the memory card 202 is mounted on the hand held terminal device 14, and is used.

A general-purpose serial interface (wired or wireless) such as USB, IEEE 1394 or InDA is used for download from this tuner device 24 to a hand held terminal device 14. Otherwise, a wired or wireless connector may be provided at the tuner device 24 such as a dedicated interface for direct connector connection. The data row received by the tuner device 24 may be directly stored in a nonvolatile memory or hard disk unit incorporated in the hand held terminal device 14 without being stored in the device.

A removable hand held terminal device 14 is connected to the tuner device 24 with the charging function shown in FIG. 3 so as to image process a group of data downloaded from this tuner device 24. This hand held terminal device 24 has an operating key 32 and a liquid crystal display monitor 122 that displays a video image operated by this operating key 32.

This liquid crystal display monitor 122 has a 320 pixels× 240 pixels color liquid crystal screen, for example. Charging is carried out for a secondary battery inserted into a recess 18 of the tuner device 24 at the lower side of this hand held terminal device 14, the secondary battery being incorporated in this hand held terminal device 14. A cross key 28 and a determination key 30 configuring the operating key 32 is provided at a casing 26 of the hand held terminal device 14 other than the above described liquid crystal display monitor 122. The determination key 30 functions as a power switch of the hand held terminal device 14 as described later.

On the other hand, other than the above recess 18, at the casing 34 of the tuner device 24, there are provided: a power reception display lamp 36 that displays a charging state indicating the end of charging; a reception display lamp 37 that displays that the hand held terminal device 14 is receiving data; a channel selection switch 38 for selecting a channel of a desired broadcast in data broadcasting.

Further, a coaxial cable 40 is connected to the tuner device 24 with this charging function, and reaches a coaxial terminal 44. An antenna 42 is connected to this coaxial terminal 44 so as to receive watch information contents D1 other than TV program broadcast caused by general grounding waves. In addition, an AC plug (alternating current plug) 48 connecting a power cable 46 is mounted on the tuner device 24. The AC plug 48 is connected to the power receptacle 50, and the AC power is supplied.

Figure 4:
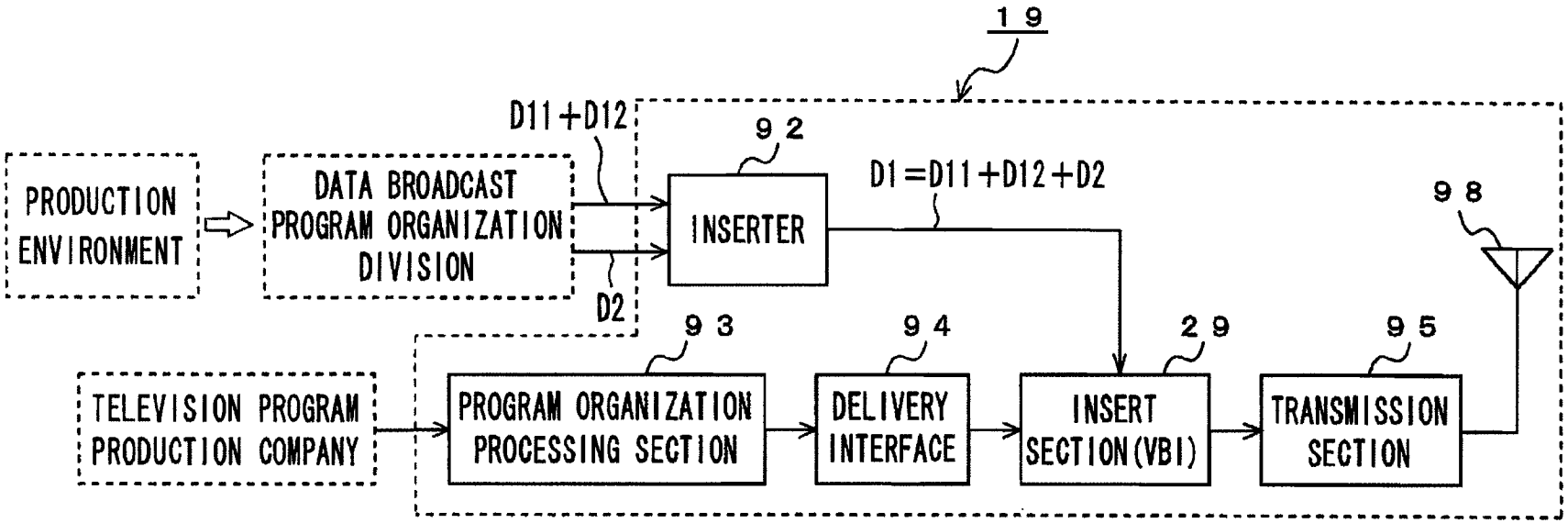
FIG. 4 is a block diagram depicting an exemplary configuration of an information distribution apparatus 19 and its peripheral system.

Now, an exemplary configuration of an information distribution apparatus 19 and its peripheral system distributed in a broadcast station 9 will be described here. The information distribution apparatus 19 shown in FIG. 4 is obtained as an apparatus for distributing the watch information contents D1 supplied from the information provider as data other than a TV program broadcast caused by general ground waves.

In this example, the watch information contents D1 relate to an analog software watch or digital software watch and contain clock display information D11 concerning clock display and time display data D12 that is time display software. Further, the clock display information D11 contains: clock frame information D110, character board information D111, long indicator, short indicator, second indicator shape information D112, and character board background information D113 of these software watches or the like. The watch information contents D1 is obtained as data in advance so as to enable video image display. Time indicating sounds such as bell sound of a famous temple is obtained as audio information.

These items of information are produced in advance according to watch information content production environment. Watch information contents D11 and D12 are provided as clock display information D11 and time display data D12 in a data broadcast program organization division. In this division, watch information contents D11 and D12 and program information D2 such as application are edited.

In addition, a television program of general ground waves is produced by a television program production company as currently scheduled. The information distribution apparatus 19 has: an inserter 92 that inserts watch information contents; an insert section 29; a program organization processing section 93 or delivery interface 94 for general television programs; a transmission section 95; and an antenna 98.

This inserter 92 is provided as an example of a data insert section. Watch information contents D11 and D12 such as graphic data or sound data and program information D2 such as application are constructed as a data row, and these watch information contents D1 are transferred to the insert section 29 to be inserted into a carrier signal.

On the other hand, television program information and commercial video caused by a ground wave data broadcast are provided from the television program production company. These television program information and commercial video are delivered to the delivery interface 94 after being organized by a program organization processing section 93 of the information distribution apparatus 19. In the delivery interface 94, the program organized television program information and commercial video are produced as a TV broadcast signal caused by the ground wave data broadcast after being converted in a predetermined broadcast format.

An insert section 29 is connected to an output stage of this delivery interface 94, and a transmission section 95 are connected to a rear stage of the interface so that watch information contents D1 concerning software watch are multiplied (VBI) as a group of data rows in a vertical blanking period of a TV broadcast signal described above. The watch information contents D1 are broadcast at a date and time (midnight) that has been specified in advance. A group of data rows inserted by this insert section 29 is irradiated from an antenna 98 by predetermined transmission electric power after being modulated by a predetermined modulation system by the transmission section 95.

In this way, according to the information distribution apparatus 19 of the present invention, in the case where watch information contents D1 concerning a software watch or the like are distributed as data by using a data broadcast infrastructure, the watch information contents D1 are constructed in a group of data rows, and are inserted into a carrier signal by means of the inserter 92. The watch information contents D1 are multiply transmitted during a vertical blanking period of a television broadcast signal (carrier signal) adopted by the data broadcast infrastructure. The television broadcast signals obtained by constructing and inserting data rows by this inserter 92 are provided so as to be transmitted from the transmission section 95 to the information user's hand held terminal device 14 in batch.

Therefore, in the information user's hand held terminal device 14, a group of data rows are received in batch in a predetermined period so that the group can be stored in batch in a storage device, for example, nonvolatile storage device such as hard disk drive. In this manner, the information user freely reads out watch information contents D1 concerning a variety of software watches by the hand held terminal device 14 in an unreal time (asynchronously) after receiving the watch information contents D1 so that a software watch such as brand watch or fashion watch can be configured.

Figure 5:
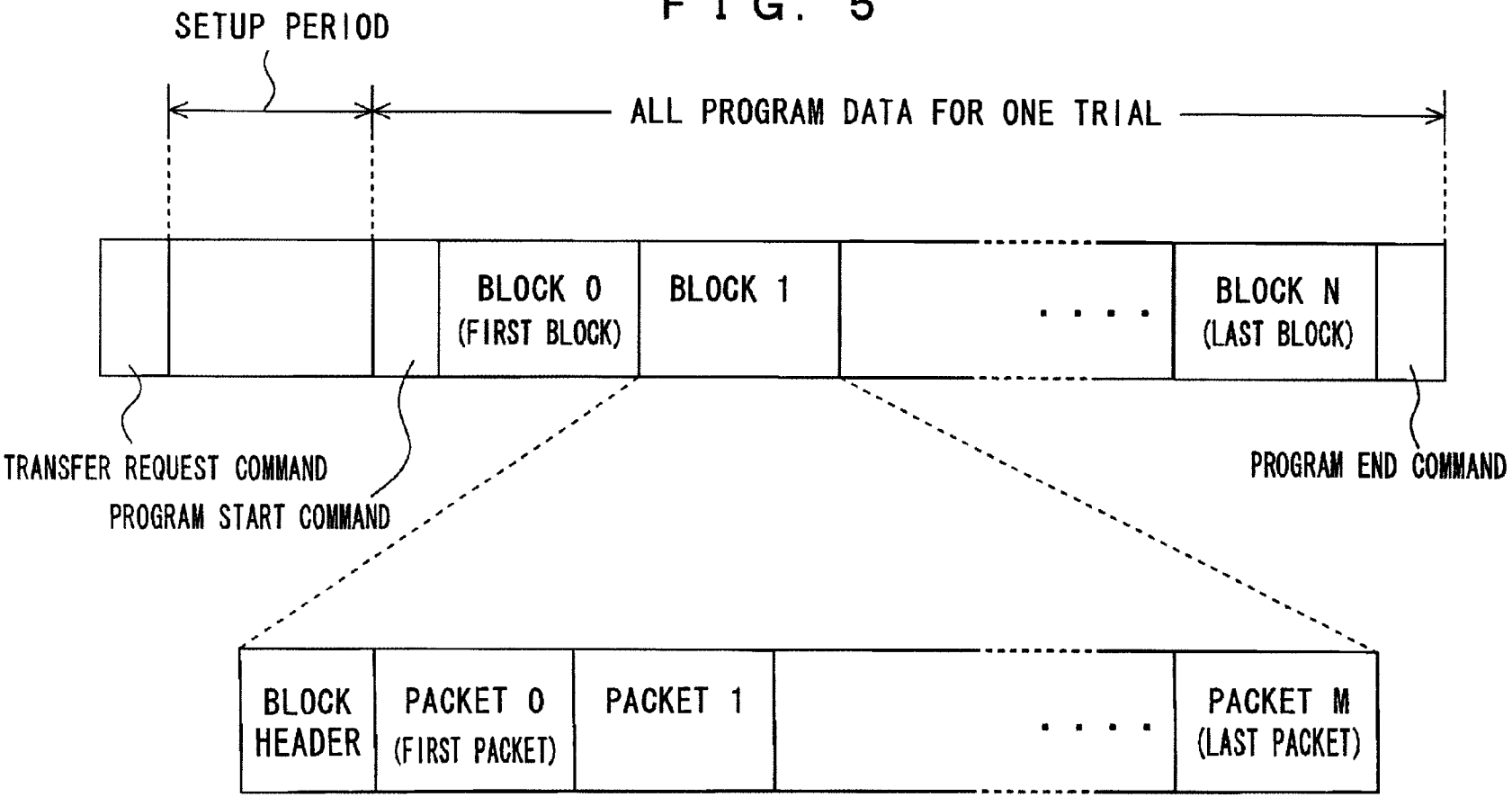
FIG. 5 is a view showing an exemplary format of a data row concerning watch information content D1.

Now, a description will be given with respect to a format of data rows applied by the software watch system 101. The format of data rows concerning the watch information contents D1 shown in FIG. 5 is prepared by the broadcast station 9 or the like, and a data main body is transmitted to be divided in packets each.

In this example, in the tuner device 24 or hand held telephone set 401 described later, a transfer request command is described at the head of a data row so as to be automatically received even at midnight. The transfer request command is provided as data for initializing (starting up) the hand held terminal device 14 or the like in a standby state. A dummy packet following this transfer request command is inserted. A dummy packet is provided so as to be form a setup period. A setup period is provided a time for the tuner device 24 or the like to enable reception.

All the program data is described after this setup period. Program data is described in a bit data format, and watch information contents D1 concerning an analog or digital software watch or the like are provided as a target. Program data is apparently described without any discrimination of clock display information D11, time display data D12, and program information D2, or alternatively program code, video image information, and audio information.

A program start command is described at the head of this program data, and then, N+1 blocks, block 0 to block N, are described. The above described watch information contents D1 or a program code and a content code for video image and audio information are described in units of blocks. Block 0 is a first block, and block N is a last block. After block N, a block end command is described. A block header is described at the head of block 1, for example, of blocks 0 to N each. A header code, attributes such as the start, middle, and end of a block, a block length such as number of packets, or a content code and the like are described at the block header.

After this block header, M+1 packets are described for each block. Packet 0 is a first packet, and packet M is a last packet. A packet code, attributes such as the start, middle, and end of a packet, and an error correction code such as parity are described in packet 1, for example, of packets 0 to M each.

Figure 6:
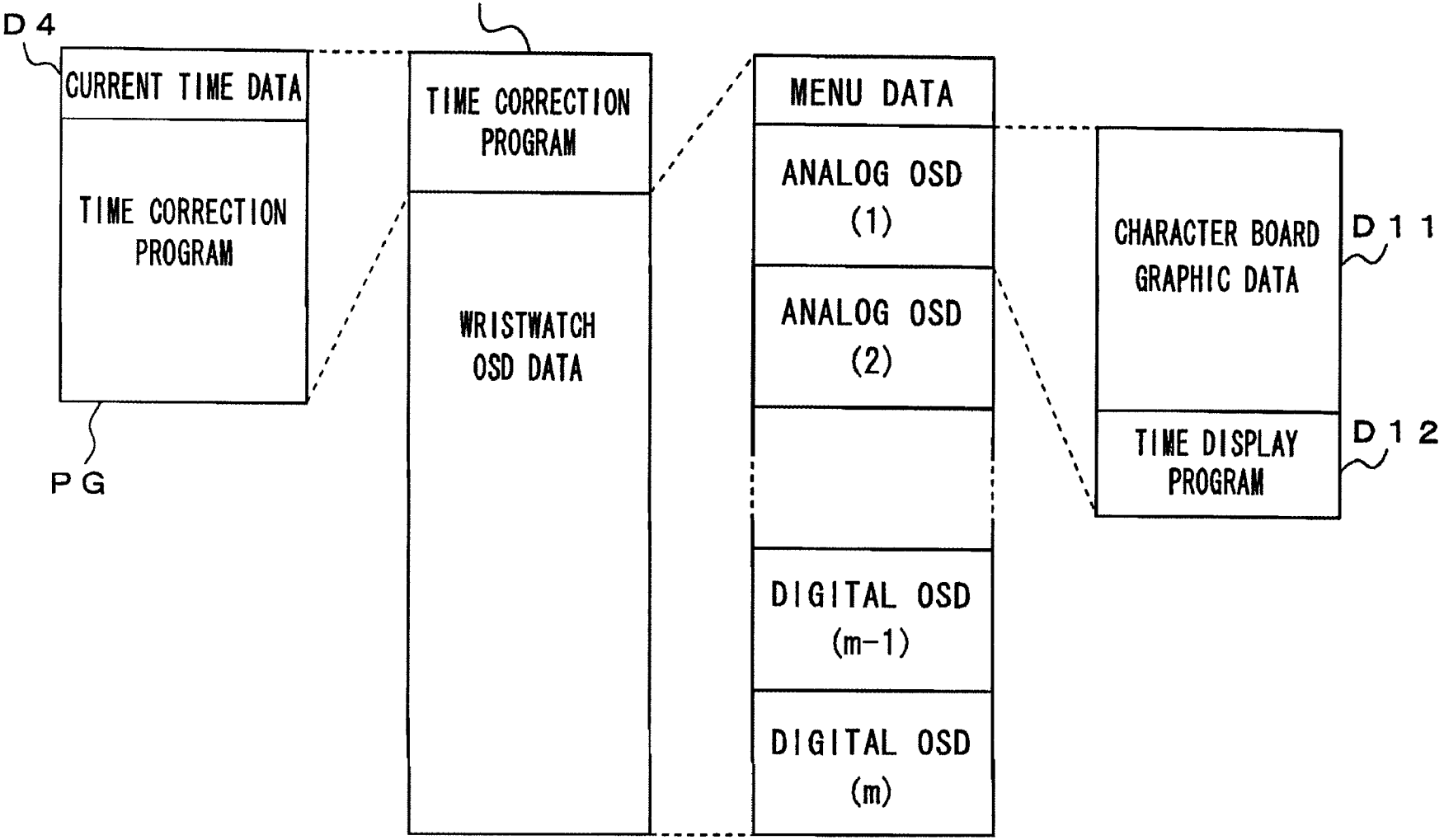
FIG. 6 is an imaginary view showing an exemplary data configuration of the watch information content D1.

FIG. 6 is an imaginary view showing an exemplary data configuration of watch information contents D1 for data distribution. Watch information contents D1 shown in FIG. 6 are composed of a time correction program and a wristwatch video image display information (hereinafter, referred to as wristwatch clock OSD data) in the case where the watch information contents D1 shown in FIG. 6 are distributed as data by using a broadcast or communication infrastructure. The time correction program is composed of current time data D4 and a time correction program PG.

The wristwatch OSD data is composed of menu data, a total of "m" types of analog OSD data (1), (2), . . . , and digital OSD data (m−1) and (m). For example, one item of analog OSD data (1) is composed of character board graphic data provided as an example of character board information D111 being clock display information D11 and a time display program provided as an example of time display data D12.

FIG. 7 shows an example of watch information contents concerning analog software. In the example shown in FIG. 7, as time frame information D110, there are described "circular." Arabic numerals 1 to 12 are described as character board information D111. As indicator shape information D112, there are described: "spade arrow" shaped long and short indicators, and a "linear" shaped second indicator. As character board background information D113, an item "plain" is described. In analog OSD data (2), a "octal shape" is described as clock frame information D110, Roman numerals "I to XII" are described as character board information D111, the "arrow" shaped long indicator and short indicator, a "linear" shaped second indicator, and character board background information D113 are described as a "landscaper" picture.

In addition, in analog OSD data (3), a "elliptical shape" is described as clock frame information D110, 12 scale character codes are described as character board information D111, the "rod" shaped long indicator and short indicator and the "linear" shaped second indicator are described as indicator shape information D112, and an "animal picture" is described as character board background information D113. In analog OSD data (4), a "heptagon" is described as clock frame information D110, 12 diamond shape codes are described as character board information D111, the "rounded line" shaped long indicator and short indicator and the "linear" shaped second indicator are described as indicator shape information D112, and a "plant picture" is described as character board background information D113.

The information user can create a software watch by using analog OSD data (1), (2), (3) . . . only. Of course, from among analog OSD data (2), an "octal shape", may be selected as clock frame information D110, and the "arrow" shaped long indicators and short indicator may be selected as needle shape information D112. From among analog OSD data (1), Arabic numerals 1 to 12 may be selected as character board information D111, and an item "plain" may be selected as character board background information D113. Although these items relate to an analog software watch, items concerning a digital software watch (not shown) are prepared.

Figure 8:
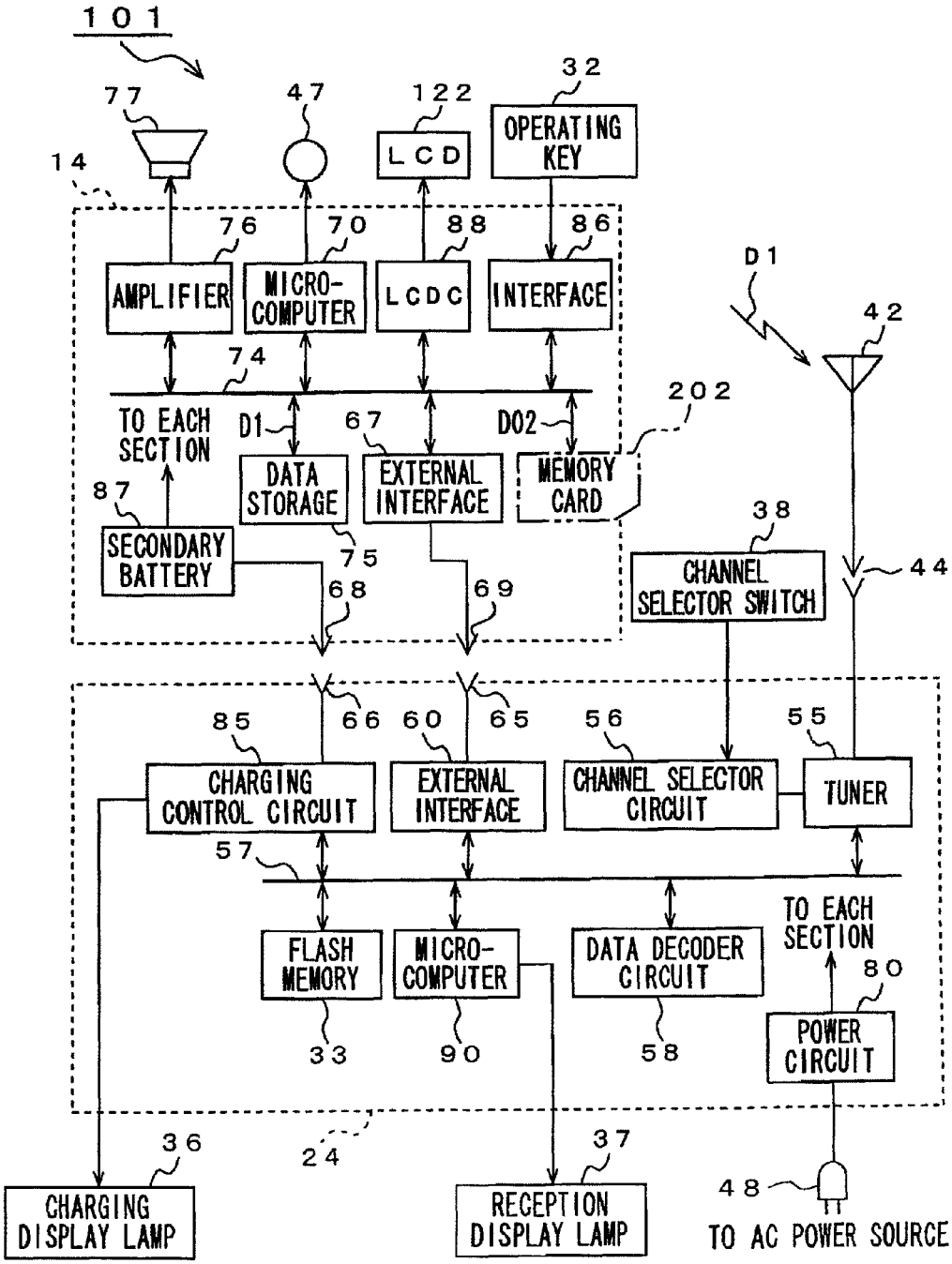
FIG. 8 is a block diagram depicting an exemplary internal configuration of a tuner device 24 with its charging function and a hand held terminal device 14.

Now, a description will be given with respect to an exemplary internal configuration of a tuner device 24 with a charging function and a hand held terminal device 14. FIG. 8 is a block diagram depicting an exemplary internal configuration of the tuner device 24 with the charging function and the hand held terminal device 14. In this system 101, the information user prepares a dedicated hand held terminal device 14 or tuner device 24 so as to receive the watch information contents D1 caused by the information distribution apparatus 19 and process the received contents as data.

In FIG. 8, the tuner device 24 has a tuner 55 that receives data externally supplied. This tuner 55 samples a data row according to watch information contents D1 from a ground wave data broadcast signal received from an antenna 42 so as to be delivered to a bus 57. A flash memory 33 is provided in the tuner device 24 so as to store the data row transferred from the bus 57.

In this example, video image and audio information according to watch information contents D1 is multiplied by using vertical blanking interleaving (VBI: vertical blanking interleaving interval) that is a gap of broadcast electric waves in accordance with an NTSC system that is a ground wave television broadcast. This makes it possible to distribute a variety of digital contents (the contents contain a video image, an image (dynamic image and static image), a variety of information such as audio, character, and numeric values; a program or commercial reproduced by a television receiver or radio receiver; and contents of magazines or newspaper). Therefore, the ground wave television broadcast electric waves can be received by mean of an antenna 42 such as conventional Yagi antenna.

Television broadcast electric waves contain electric waves of a plurality of channels. In order to select and receive a desired channel, a selection frequency of a tuner 55 is configured so as to be switched through a channel selector circuit 56 based on channel information set by a channel selector switch 38. A data row (NTSC signal used here) selected by the tuner 55 and supplied to the bus 57 is decoded by means of a data decoder circuit 58.

When a data row according to a variety of the contents multiplied as a VBI at the broadcast station 9 is present with an NTSC signal in the tuber device 24, the decoded video image and audio information and data such as watch information contents D1 are temporarily stored in a flash memory 33 under the control of a microcomputer 90, including a case in which the hand held terminal device 14 is not set.

When this hand held terminal device 14 is set at the tuner device 24, watch information contents D1 may be directly transferred to the hand held terminal device 14 at the same time through an external interface 60 that is a serial interface or a connector terminal 65. These microcomputer 90 and data decoder circuit 58 are configured as an internal system LSI.

Although a removable hand held terminal device 14 is set at this tuner device 24, it is considered that watch information contents D1 concerning a software watch or the like are often removed from the tuner device 24, and are processed. After data broadcasting, for example, the watch information contents D1 stored in a flash memory 33 of the tuner device 24 are provided so as to be downloaded in a hand held terminal device 14.

This hand held terminal device 14 has a bus 74. To this bus 74, there are connected an external interface 67, a microcomputer 70, a data storage 75, an amplifier 76, an interface 86, and a liquid crystal display controller (LCDC) 88. In addition, a memory card 202 is mounted through a connector terminal (not shown).

In addition, a data row delivered to the hand held terminal device 14 through a connector terminal 65 of the tuner device 24 is electrically written into a storage device, preferably a data storage 75 as a nonvolatile storage device, under the control of a microcomputer 70 through a connector terminal 69 of the hand held terminal device 14, an external interface 67 that is a serial interface and a bus 74.

Clock screen information that configures a plurality of software watches is provided so as to be stored in this data storage 75. This is because the information user can enjoy a software watch freely according to the preference.

The microcomputer 70 is provided as an example of a display control section. This microcomputer receives and stores watch information contents D1, reads out watch information contents D1 from the data storage 75 asynchronously according to the information user's information operation, and controls the watch information contents D1 to be displayed as a video image. This microcomputer 70 is provided so as to display and control a video image concerning a software watch that consists of a three-dimensional video image obtained by processing the watch information contents D1.

In the case where a time indicating sound is set, such sound is controlled so as to be outputted as an audio. In this example, an automatic background variable mode is prepared so as to automatically display a character board background video image adapted to the season according to watch information contained in the hand held terminal device 14. Of course, a character board background video image adapted to the time interval, for example, an item "sunset" may be automatically displayed in evening, for example, without being limited to the season. A time sense and season sense can be provided according to such automatic background variable mode.

Otherwise, in the microcomputer 70, a memory card 202 is mounted to display and control game data D02, and watch information contents D1 are acquired from the software watch memory card 202 so as to display and control the software watch.

A read-only memory (EEPROM) or the like in which information can be electrically written and erased is used in the above described data storage 75. In this example, even if the hand held terminal device 14 is not set at the tuner device 24, the data row is provided so as to be electrically stored in the flash memory 33. When the hand held terminal device 14 is set at the tuner device 24, the data row is provided so as to be transferred to the data storage 75 of the hand held terminal device 14 under the control of the microcomputer 90.

As a storage capacity of the flash memory 33 or data storage 75, in the case where a data rate of a data broadcast is about 40 [kbps], if an attempt is made to store the data at least for about 50 minutes, a 16 [MB] capacity may be used. The result is 40 [kbps]/8 [bits]×50 [minutes]×60 [seconds]=15 [MB].

The microcomputer 70 is provided as a digital computer. Watch information contents D1 are arbitrarily processed as a video image based on program information D2 read out from the data storage 75. Alternatively, game data D02 is processed as an image based on a video image and audio information read out from the memory card 202.

The microcomputers 70 and 90 each have: a CPU (central processing unit), a ROM that is a memory (including EEPROM); and a RAM (random access memory). Otherwise, these computers each have an input/output interface, a clock provided as clock means, and a timer or the like provided as clocking means. The computers each function as a control section, a computing section, and a processing section and the like. Therefore, as described above, the functions of the data decoder circuit 58 can be executed by means of the microcomputer 90.

A reception display lamp 37 is connected to the microcomputer 90 at the tuner device 24. This reception display lamp 37 is controlled to light while data is transferred from the tuner device 24 to the data storage 75 and whole data is stored in the data storage 75. Otherwise, the lamp is controlled to be turned OFF. The reception display lamp 37 may blink upon the completion of reception of a data row.

This tuner device 24 further has a power circuit 80. This power circuit 80 converts an alternating current voltage such as 100 VAC supplied from an external AC power source into a direct current voltage, and supplies the converted voltage to all blocks in the tuner device 24. In this case, a charging control circuit 85 converts a direct current voltage supplied from the power circuit 80 into a charging direct current, for example, supplies the converted current to a secondary battery 87 of the hand held terminal device 14 via a connector terminal 68 of the hand held terminal device 14 through a connector terminal 66, and control charging.

In charging control contained in the charging control circuit 85, for example, a charging current is controlled while a temperature of a secondary battery 87 is detected, thereby carrying out residual capacitance detection control and full charge detection control of the secondary battery 87. As the secondary battery 87, a lithium ion battery or a nickel hydrogen battery and the like can be used.

A charging display lamp 36 is connected to the charging control circuit 85. This charging display lamp 36 is controlled so as to light while the secondary battery 87 is being charged and to turn OFF during full charging. An operating key 32 is further connected to the bus 74 via the interface 86, and a liquid crystal display monitor 122 is connected to the bus via a liquid crystal display controller 88. An audio processing section 76 is connected to the bus 74 described above so that audio amplification processing is done. A speaker 77 is connected to the audio processing section 76 so as to output audio information such as time indicating sound according to watch information contents D1.

Figure 9:
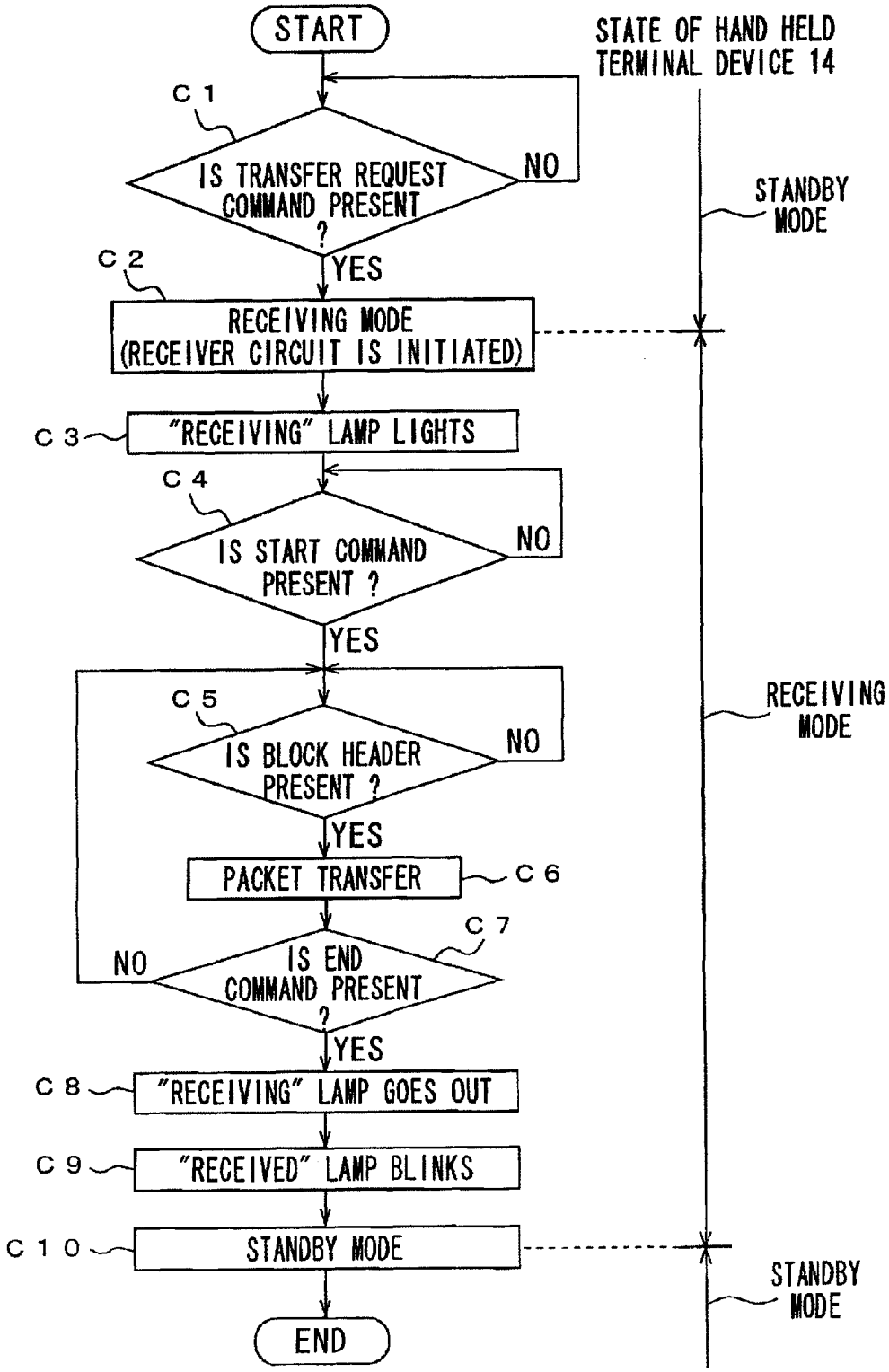
FIG. 9 is a flow chart showing an exemplary operation of the tuner device 24 in the software watch system 101.

Now, a processing example of a software watch system 101 will be described here. FIG. 9 is a flow chart showing an exemplary operation of the tuner device 24 in the software watch system 101.

In this example, watch information contents D1 concerning the software watch are provided as a data row so that the data row is distributed from the broadcast station 9 to the information user. The watch information contents D1 are provided as a time correction program or wristwatch OSD data according to the software watch created by the information provider.

In this example, while the hand held terminal device 14 is set at the tuner device 24, and waits for data download, the hand held terminal device 14 is established in a standby mode. The standby mode used here denotes that a system LS1 such as a microcomputer 70 of the hand held terminal device 14 and an LCDC 88 is turned OFF excluding an interface function with the microcomputer 90 of the tuner device 24 and a clock function.

In this interface function as well, unlike general data transfer, a startup command from the microcomputer 90 can be polled at the required minimum low speed. In the tuner device 24, in order to detect a transfer request command, power is supplied from the power circuit 80 to each section. In addition, the hand held terminal device 14 is set at the tuner device 24, and the secondary battery 87 is charged by the charging control circuit 85 during this period.

With this being presumed, the tuner device 24 is established in a standby mode, and a transfer request command transmitted from the broadcast station 9 is detected at the step C1 in the flowchart shown in FIG. 9. In the case where a transfer request command is detected by the tuner device 24, a transfer request command for notifying the start of downloading from the tuner device 24 to the hand held terminal device 14 is transmitted. Thus, at the hand held terminal 14, the microcomputer 70 itself initiates the hand held terminal device 14 to enter a receiving mode at the step C2 by utilizing a setup period.

The receiving mode used here denotes an intermediate mode between a standby mode and a normal (normal use) mode. In the microcomputer 70, in addition to the standby function, a high speed interface function with the tuner device 24 and an external memory interface function for transferring the data captured here to data storage 75 such as a flash memory are further turned ON. Therefore, at this time, power is supplied from the secondary battery 87 to the data storage 75 and microcomputer 70 or the like.

Then, processing goes to the step C3 at which a reception display lamp 37 indicating that data row receiving is in process is lit by the microcomputer 90 of the tuner device 24. The charging display lamp 36 lights when the hand held terminal device 14 is set at the tuner device 24. The hand held terminal device 14 waits for a program start command from the tuner device 24.

In addition, it is detected by the microcomputer 90 whether or not the program start command is described with respect to a data row following the setup period in the step C4. This program start command is obtained as a signal that notifies the start of transferring all the programs to be downloaded once. The data on all the programs is divided into a plurality of blocks, as described in FIG. 5. Therefore, when a block start command is received (detected), processing goes to the step C5 at which it is detected whether or not a block header is described at a packet of a first (starting) block 0.

In the case where this block header is detected, processing goes to the step C6 at which packet transfer processing is executing while a hand shake is obtained for a packet shaped data group finely divided in blocks in the microcomputers 70 and 90. Namely, when a data row is received at the tuner device 24, the data row is decoded to binary data by means of a data decoder circuit 58 as required.

Then, watch information contents D1 concerning a software watch as a decoded data file are transferred to the flash memory 33 or the like, and are temporarily stored therein. In this example, the decoded data file is transferred to the flash memory 33 and the storage 75 of the hand held terminal device 14 at the same time. Thus, even if the information user fails to set the hand held terminal device 14 at the tuner device 24, data file after received can be transferred again from the tuner device 24 to the hand held terminal device 14.

An end flag indicating the end of the block is described at the end of this packet. Then, when the microcomputer 70 recognizes this, processing goes to the step C7 at which it is detected whether or not a program end command is described following the packet end flag. In the case where the program end command is not detected, processing reverts to the step C5 at which it is detected whether or not a next block header is described.

In this way, when data files are transferred from the tuner device 24 to the data storage 75 one after another until the program end command has been detected, and then, all the data rows are temporarily stored in the flash memory 33 or data storage 75 and the like according to the buffer memory in the microcomputer 70, processing goes to the step C8 at which the reception display lamp 37 of the tuner device 24 is turned OFF by means of the microcomputer 90. The "receiving" indicator 47 of the hand held terminal device 14 is turned OFF by means of the microcomputer 70 having received the program end command.

Then, processing goes to the step C9 at which the "received" lamp blinks at the tuner device 24 and hand held terminal device 14. The "received" lamp may be compatible with a reception display lamp 37 or "receiving" indicator 47. Then, processing goes to the step C10 at which the hand held terminal device 14 enters a standby mode.

FIG. 10A to FIG. 10D are charts each showing an assembly example of an analog software watch 1. In this example, arbitrary clock frame information D110, character board information D111, indicator shape information D112, and character board background information D113 are selected from among analog OSD data (1), (2), (3), (4) . . . shown in FIG. 7, a user specific software watch 1 is produced, and then, time display data is composed so as to clock a time.

Figure 10A:
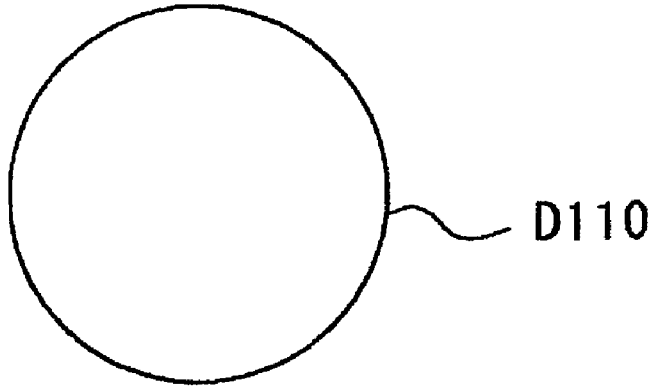
FIG. 10A to FIG. 10D are process views each showing an exemplary assembly of an analog software watch 1.
Figure 10B:
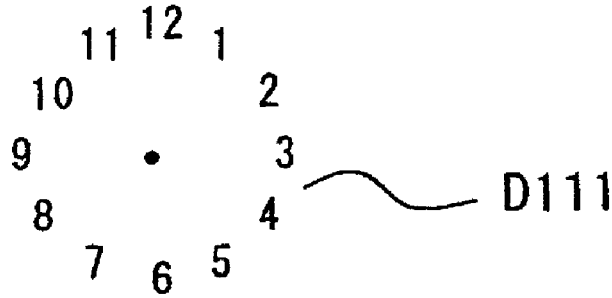

With this being presumed, the operating key 32 shown in FIG. 8 is operated so as to read out menu data to the liquid crystal display monitor (LCD) 122. Then, clock frame information D110 on "a circular shape" as shown in FIG. 10A is selected from (1) of the analog OSD data (1), (2), (3), and (4) shown in FIG. 7, for example.

At this time, the operating key 32 is operated so as to read out the watch information contents D1 from the data storage 75 to the liquid crystal display monitor (LCD) 122. Then, in FIG. 10B, for example, character board information D111 on Arabic numerals 1 to 12 of analog OSD data (1) is selected on the liquid crystal display monitor 122 in order to be combined with the clock frame information D110 on "the circular shape".

Figure 10C:
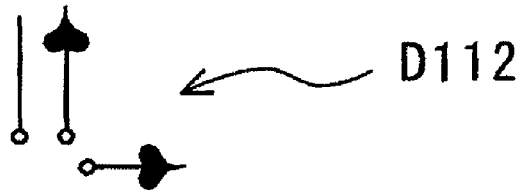

Then, in the FIG. 10C, indicator shape information D112 according to the long and short indicators consisting of "spade arrow" and the "straight" second indicator of analog OSD data (1) is selected similarly. In this example, an item "plain" is selected for the character board background information D113. Of course, items "landscape picture", "animal picture", and "plan picture" or the like may be combined with each other without being limited to the item "plain" with respect to the character board background information D113.

Figure 10D:
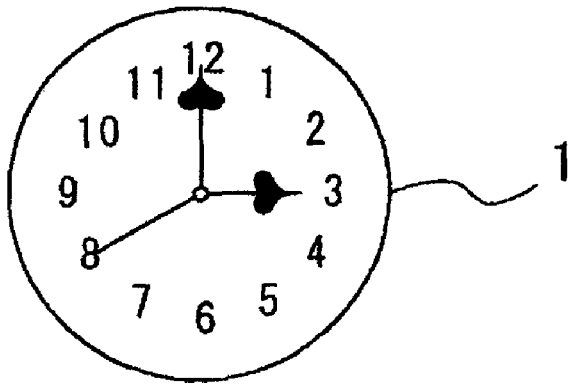

When these clock frame information D110, character board information D111, indicator shape information D112, and character board background information D113 are combined with each other, an analog wristwatch shown in FIG. 10D is completed. Here, accessory information such as accessories including wristbands or jewels of wristwatch may be combined. Of course, such accessory information is prepared by the information provider in advance so as to be downloaded together with character board background information D113 or the like. In this manner, a user specific analog software watch 1 can be created, and this watch can be displayed as a video image on the liquid crystal display monitor 122. In this circumstance, a time cannot be clocked.

Figure 11A:
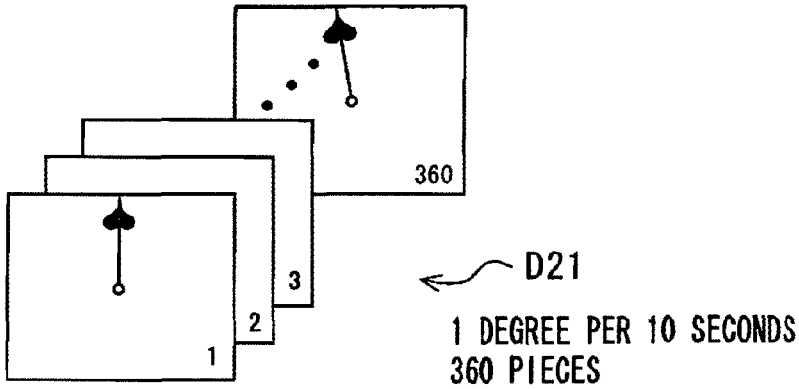
FIG. 11A to FIG. 11C are imaginary views each showing an example of clock display data D12 of the analog software watch 1.

Then, clock display data on analog software watch 1 shown in FIG. 11A to FIG. 1 IC are provided so as to be composed. In this example, assume that a time is clocked by a geometrical angle of 1 degree with respect the longer and shorter indicators and the second indicator.

Figure 11B:
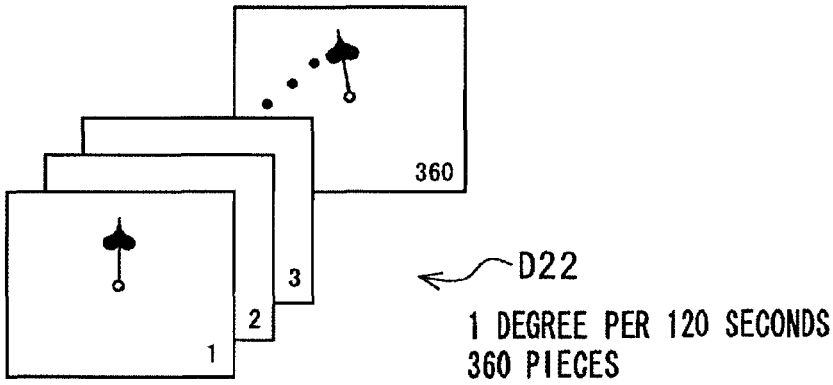
Figure 11C:
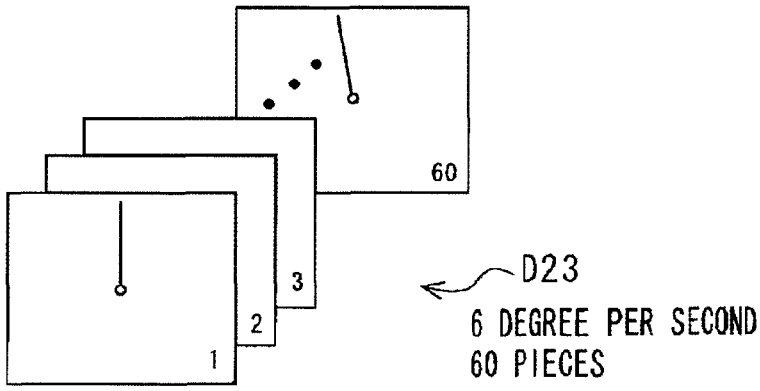

With respect to a video image of the longer indicator of the software watch 1 completed in FIG. 10D, there is prepared 360 video image data D21 on the longer indicator as shown in FIG. 11A in which a video image of the longer indicator changes at a rate of 1 degree per 10 seconds. With respect to a video image of the shorter indicator of the software watch, 360 video image data D22 on the shorter indicator as shown in FIG. 11B is prepared in which a video image of the shorter indicator changes at a rate of 1 degree per 120 seconds. With respect to a video image of the second indicator, 60 video image data D23 on the second indicator as shown in FIG. 11C is prepared in which a video image of the second indicator changes at a rate of 6 degrees per second.

Of course, addresses are described in 360 video image data D21 and D22 each according to the longer and shorter indicators and 60 video image data D23 according to the second indicator. When an arbitrary time is synchronized, video image data D21, d22, and D23 according to the longer and shorter indicators and the second indicator of an address indicating the time area are read out from the data storage 75. After time synchronization, the video image data D21, D22, and D23 according to these longer and shorter indicators and the second indicator are controlled to be displayed based on an operation clock of the microcomputer 70 in the hand held terminal device 14. Information concerning the completed software watch 1 is stored in the data storage 75.

In this manner, a time can be clocked such as the video image of a second indicator changes by 6 degrees per second by the software watch 1, the video image of the longer indicator changes at a rate of 1 degree per 10 seconds, and the video image of the shorter indicator changes at a rate of one degree per 120 seconds. The character board background information D113 is composed as still pictures such as "landscape picture", "animal picture", and "plant picture" and the like. The character board background information D113 is provided to be displayed and controlled in units of the time or in units of seasons.

Figure 12:
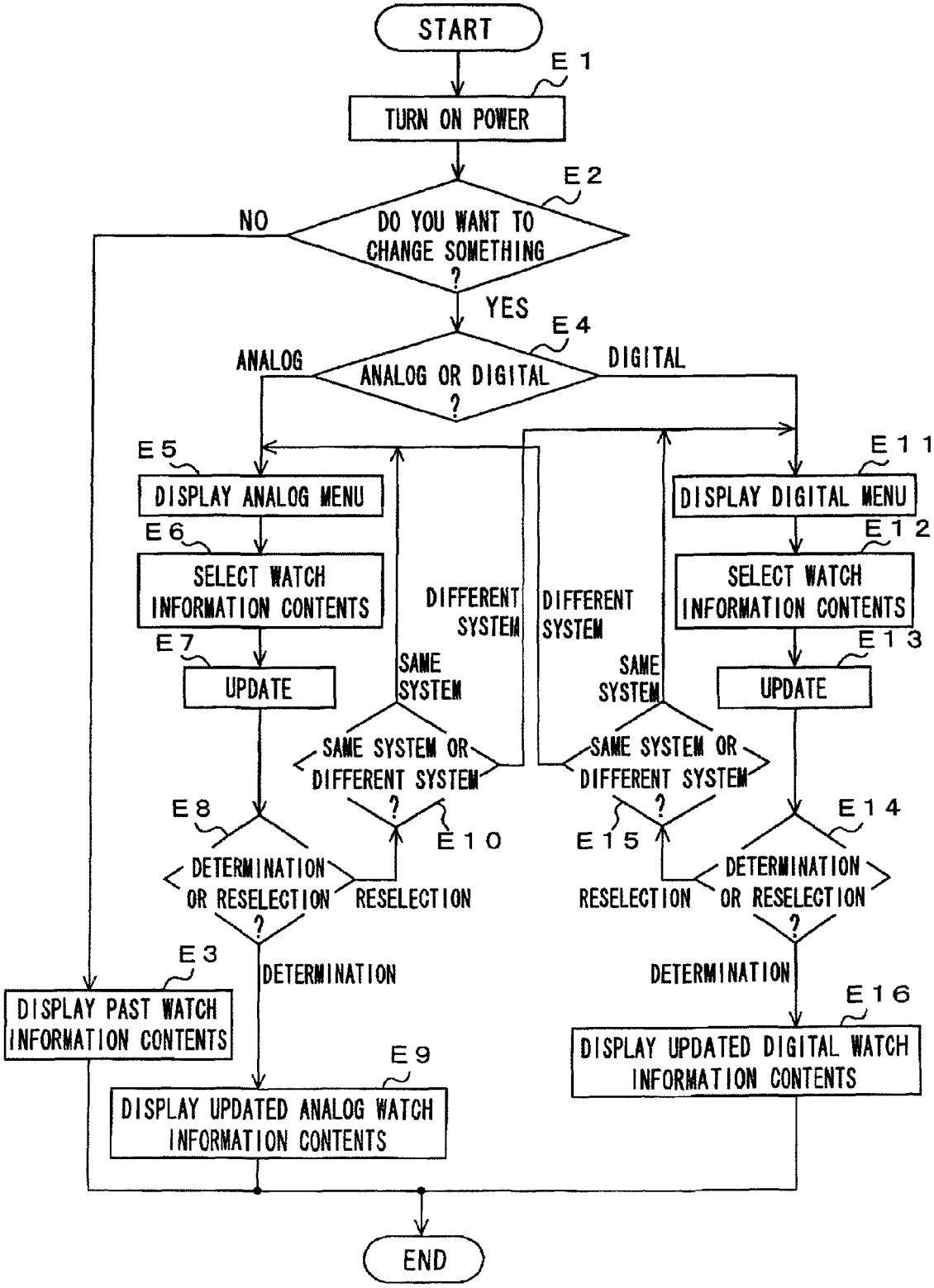
FIG. 12 is a flow chart showing an exemplary change of the software watch 1.

FIG. 12 is a flow chart showing a change example of the software watch 1. In this example, there is shown a case in which the software watch 1 as shown in FIG. 10D clocks a time in the hand held terminal device 14, and this software watch 1 is recreated (changed).

With this being presumed, at the step E1 in the flow chart shown in FIG. 12, power of the hand held terminal device 14 is turned ON to enter a software watch mode. Then, at the step E2, it is checked whether or not the software watch 1 is changed. Change of the software watch 1 is made based on the information user's discretion. In the case where the software watch 1 is not changed, processing goes to the step E3 at which a time is clocked by the software watch 1 based on the past clock display contents D1.

In the case where the software watch 1 is changed at the step E2, processing goes to the step E4 at which analog type or digital type is selected by operating the operating key 32. In the case where analog type is selected, processing goes to the step E5 at which an analog menu screen is displayed on the liquid crystal display monitor 122. Then, processing goes to the step E6 at which clock frame information D10, character board information D111, indicator shape information D112, and character board background information D113 are selected from among the watch information contents D1 as shown in FIGS. 10A to 10D, and a new software watch 1' is created.

Then, at the step E7, the past information concerning the software watch 1 is updated. Information concerning a new software watch 1' is updated by the data storage 75. Then, processing goes to the step E8 at which it is checked whether or not the new software watch 1' is determined. The determination of the new software watch 1' is made based on the information user's discretion.

In the case where the new software watch 1' is determined, processing goes to the step E9 at which the software watch 1' is displayed as a video image on the liquid crystal display monitor 122 based on the updated analog watch information contents D1, and a time is clocked based on the time display data. Here, when the information user roughly sets the current time, the current time is displayed as a video image by means of the software watch 1' based on the current time data D4 in a time correction program.

In addition, in the case where the new software watch 1' is not determined at the step E8, and the watch information contents D1 are selected again, processing goes to the step E10 at which it is checked whether or not the same or different system is provided. This system check is made based on the information user's discretion. In the case of the same system, processing goes to the step E5 at which the same processing as that described above is repeated. In the case of the different system and in the case where the digital type is selected at the step E4, processing goes to the step E11.

At the step E11, a digital menu is displayed on a liquid crystal display monitor 122. Then, processing goes to the step E12 at which the operating key 32 is operated so as to select watch information contents D1.

Then, at the step E13, past information concerning the software watch 1 is provided to be updated in the data storage 75.

Then, processing goes to the step E14 at which it is checked whether the new software watch 1' is determined. The determination of the new software watch 1' is made based on the information user's discretion. In the case where the new software watch 1' is determined, processing goes to the step E16 at which the software watch 1' is displayed as a video image on the liquid crystal display monitor 122 based on the updated digital watch information contents D1, and a time is clocked based on the time display data.

In the case where the new software watch 1' is not determined, and watch information contents D1 are selected again at the step E14, processing goes to the step E15 at which it is checked whether the same system or different system is provided. In the case of the same system, processing goes to the step E11 a which the same processing as that described above is repeated. In the case of the different system, processing goes to the step E5 at which an analog menu is displayed on the liquid crystal display monitor 122. Then, processing goes to the step E6 at which watch information contents are selected. Then, at the step E7, the past information concerning the software watch 1 is provided so as to be updated in the data storage 75.

In this way, in a software watch system 101 according to the first example of the present invention, after receiving the watch information contents D1, a new software watch 1' such as brand clock or fashion clock can be configured by freely combining the watch information contents D1 concerning a variety of clocks in an unreal time (asynchronously). The hand held terminal device 14 displays the software watch 1' based on the watch information contents D1 on the liquid crystal display monitor 122 and clocks a time.

Moreover, the information user can select one software watch 1 from among a number of types by means of simple information operation. Thus, the user can use a preferable software watch 1 according to the time, the place and the occasion, and can enjoy the software watch 1 freely according to the preference.

A plurality of software watches 1 with different designs can be configured according to the information user's preference. In addition, in the case where these software watches 1 are used, physical replacement such as real wristwatch of a conventional system can be eliminated. Alternatively, the user does not wear the wristwatch directly around one's wrist, and the wristwatch does not block manual work or is not damaged, and the user does not feel discomfort caused by sweat.

SECOND EXAMPLE

Figure 13:
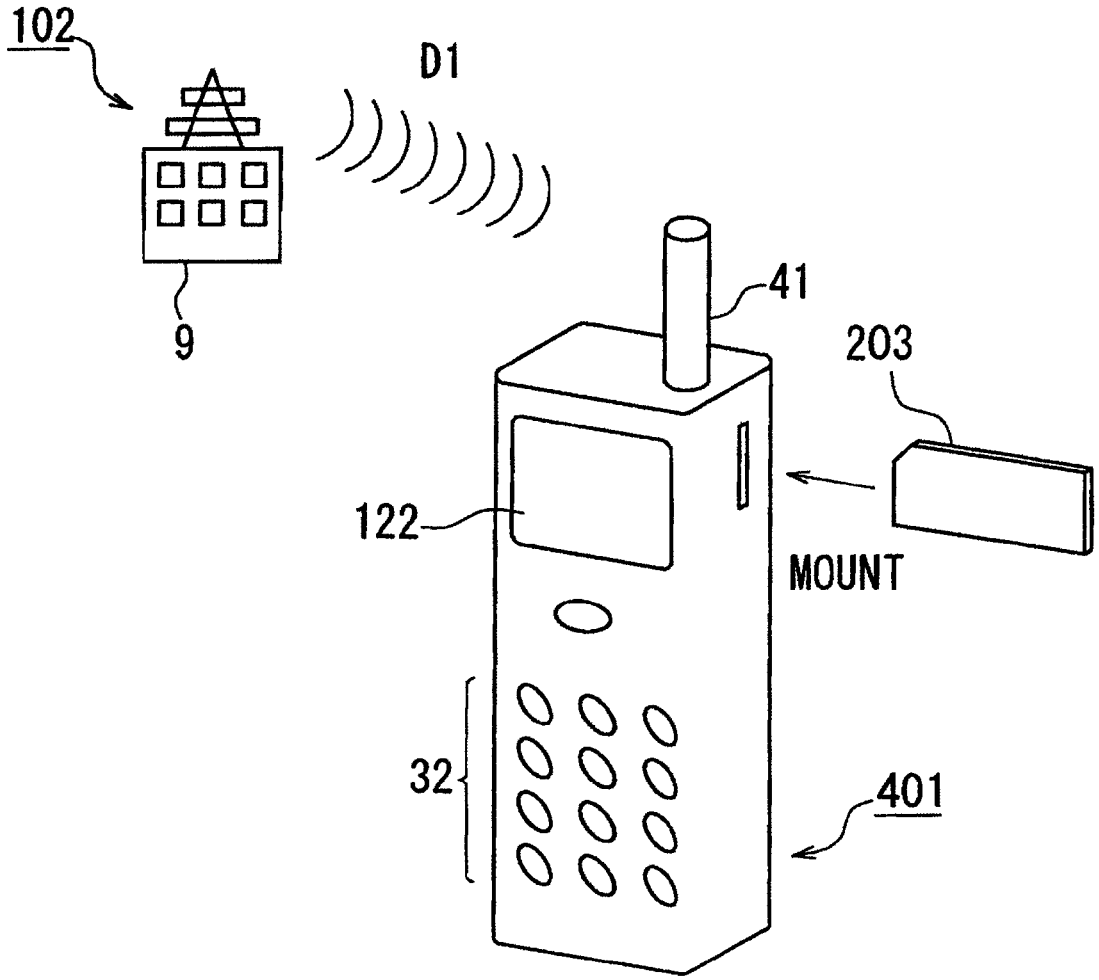
FIG. 13 is an imaginary view showing an exemplary configuration of a software watch system 102 according to a secondary example of the present invention.

FIG. 13 is an imaginary view showing an exemplary configuration of a software watch system 102 according to a second example of the present invention.

In this example, there is provided a system such that the tuner function and decode function shown in FIG. 8 are incorporated in a hand held telephone set 401 shown in FIG. 13, and watch information contents D1 are directly received by this hand held telephone set 401. The distribution infrastructure of the watch information contents D1 may be a broadcast infrastructure or a communication infrastructure as in the first example. Of course, one wears and uses a memory card 203 provided as an example of an information recording medium having recorded therein watch information contents D1' concerning a variety of clocks. This memory card 203 is provided by using the existing sales infrastructure.

In the case where watch information contents D1' are distributed by this memory card 203, the contents are provided by using the existing sales infrastructure. Thus, the contents may be separated from a broadcast or communication infrastructure. Namely, watch information contents D1' such as video image information on clock character board or time display software are provided to be on sale in the city as a package medium. Moreover, the information user purchases wristwatch OSD information as a package medium at shop as if one purchase a wristwatch at mass-sales shop or the like.

In addition, the information user wears the memory card 203 on the dedicated hand held terminal device or hand held telephone set 401 to create a software watch 1, and then, the user can display or utilize the watch on the liquid crystal screen of the hand held telephone set 401 or the like. This is a software distribution mode similar to conventional music CD or video game software.

In this manner, the information user wears the memory card 203 around the hand held telephone set 401, and combines watch information contents D1' concerning a variety of clocks with each other in an unreal time (asynchronously), thereby making it possible to construct a software watch such as brand watch or fashion watch.

Figure 14:
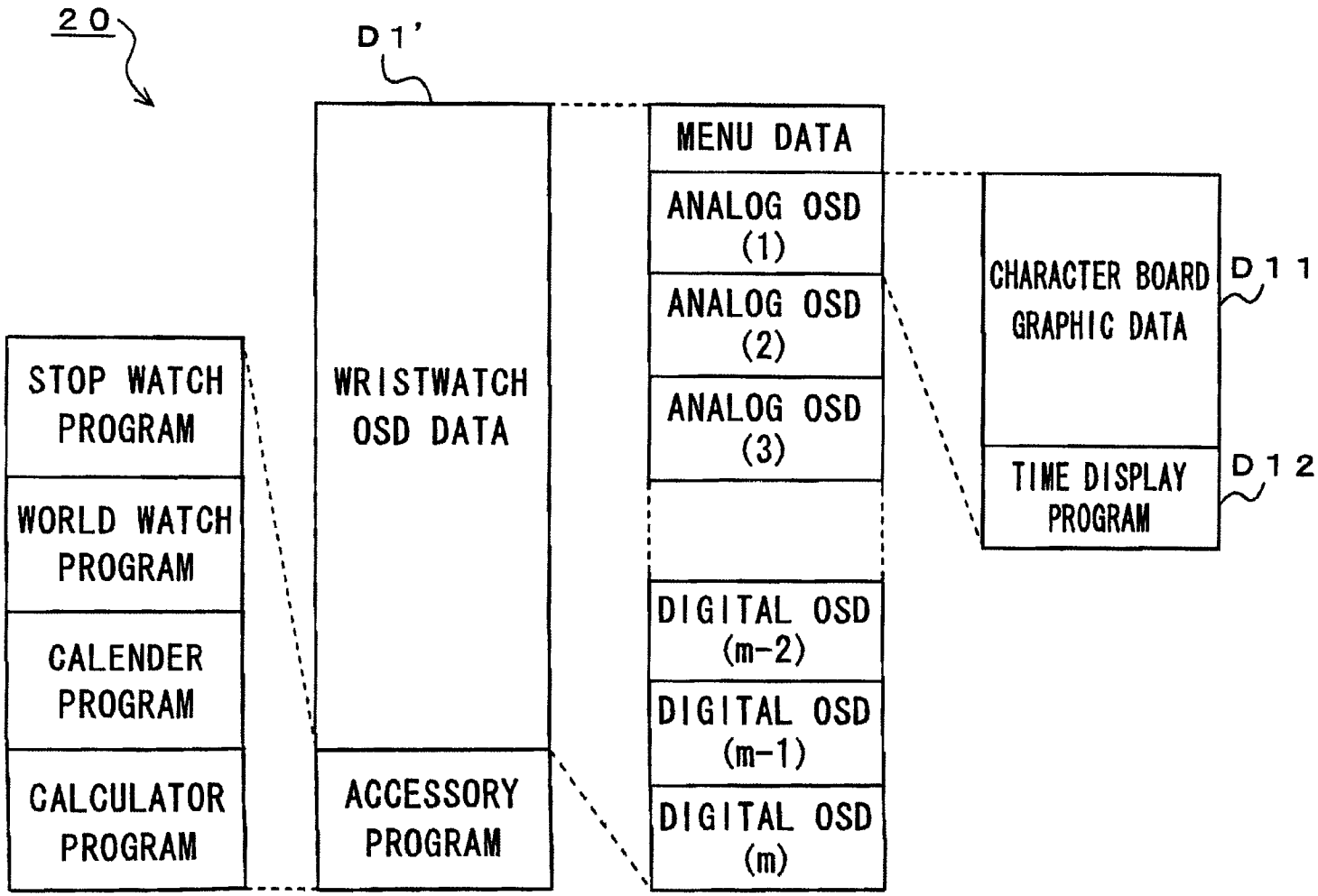
FIG. 14 is an imaginary view showing an exemplary data configuration in a memory card 203.

FIG. 14 is an imaginary view showing an exemplary data configuration of the memory card 203. In the case where watch information contents D1' are provided by a package medium such as the memory card 203, a larger amount of information can be handled as compared with data distribution. The watch information contents D1' shown in FIG. 14 are composed of wristwatch OSD data (wristwatch video image display information and a accessory program.

Some tens of types of analog OSD data and some tens of types of digital OSD data are described for the wristwatch OSD data. A time correction program such as watch information contents D1 for data distribution is not added to watch information contents D1' for this package medium. This is because the purchase period of the memory card 203 is different depending on the information user, and time information cannot be handled in a real time. An accessory program is composed of a stop watch program, a world clock program, a calendar program, and a calculator program.

This accessory program is provided so as to contain data for displaying a seasonal background graphics depending on seasons or graphics such as landscapes including early afternoon landscape or evening landscape depending on a time. A variety of performances can be achieved by automatically switching and displaying these items of graphic data. The wristwatch OSD data is substantially similar to the watch information contents D1 for data distribution. Thus a description is omitted here.

Figure 15:
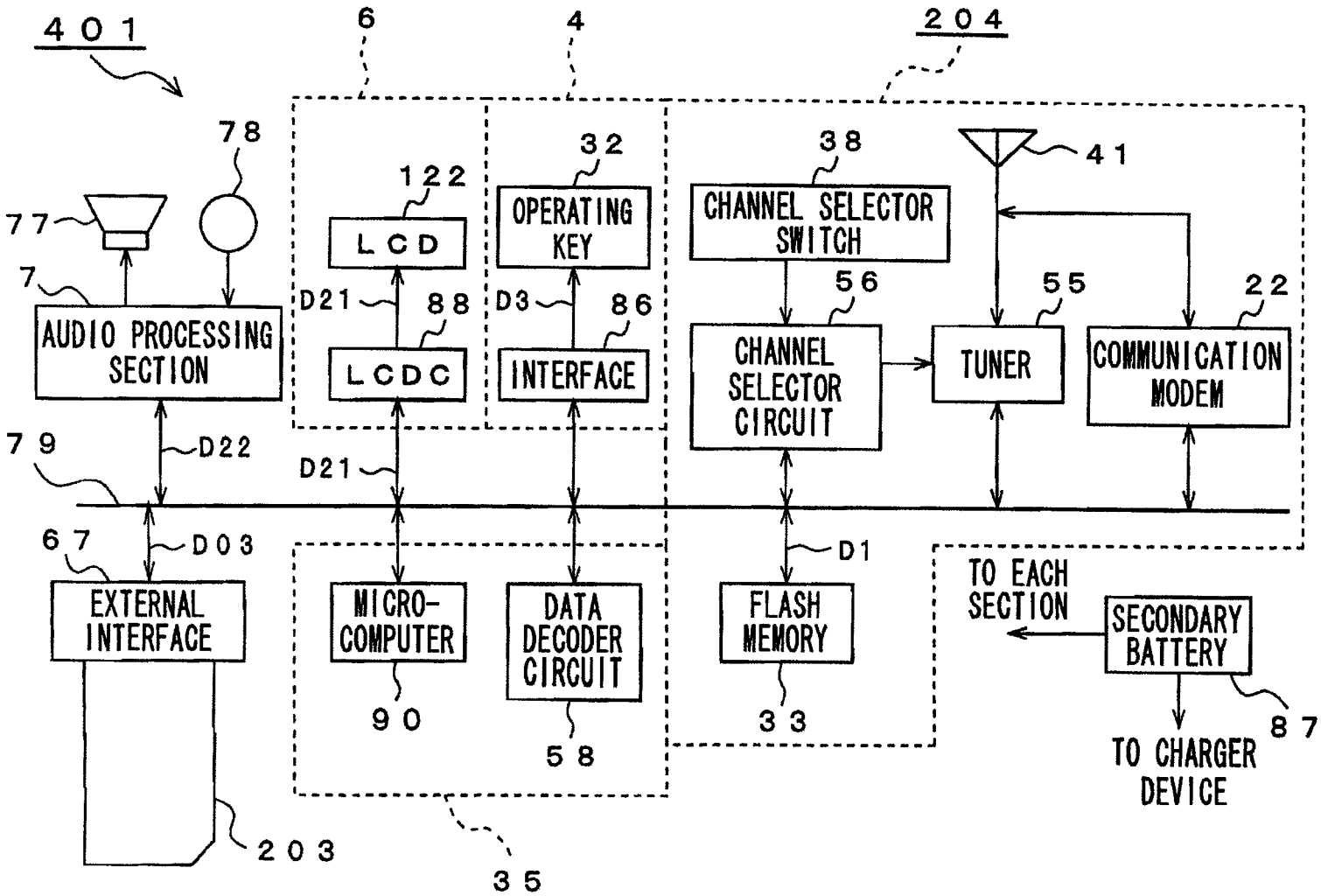
FIG. 15 is a block diagram depicting an exemplary internal configuration of a hand held terminal device 401.

Now, an exemplary internal configuration of a hand held telephone set 401 with a tuner function will be described here. FIG. 15 is a block diagram depicting an exemplary internal configuration of the hand held telephone set 401. The same reference numeral and the same name as the hand held terminal device 14 have like functions. Thus a description is omitted here.

The hand held telephone set 401 shown in FIG. 15 is provided as an example of a first hand held terminal device, processes watch information contents D1 from the broadcast station 9 and watch information contents D1' or game data D03 from the memory card 203 and the like, and has a system bus 79.

To this system bus 79, there are connected an operating section 4, a display section 6, an audio processing section 7, a data processing section 35, an external interface 67, a receiving section 204 or the like, and these elements are driven by means of a secondary battery 87.

A memory card 203 is mounted on this external interface 67, and the watch information contents D1' concerning a variety of clocks produced by the information provider are stored. A nonvolatile memory such as a flash memory is used for the memory card 203. The receiving section 204 has a tuner 55, a communication modem 22, a channel selector switch 38, a channel selector circuit 56, and a flash memory 33, receives watch information contents D1 concerning a variety of clocks by means of the tuner 55 so as to store data such as video image and audio information after decoded or watch information contents D1 in the flash memory 33.

In this example, the data processing section 35 has a data decoder circuit 58 and a microcomputer 90. The data processing section 35 has an additional function for reading out and processing a time correction program stored in the flash memory 33 other than a general telephone function, and mounting the memory card 203 so as to process time information contents D1' or game data D03.

In this microcomputer 90, the time information contents D1 are associated with time information that has already managed by the hand held telephone set 401. For example, when time information being a reference is distributed as data from the information provider to the information user's hand held telephone set 401, the information user corrects watch information managed by the hand held telephone set 401 based on time information defined as a reference. In this manner, there is no need to worry about an error of the software watch 1 because such error can be corrected automatically or by simple operation.

In addition, an interface (I/F) 86 configuring an operating section 4 is connected to a system bus 79, an operating key 32 is connected to this interface 86. The operating key 32 is operated so as to control the data decoder circuit 58 and microcomputer 90.

Further, a liquid crystal display controller (LCDC) 88 configuring a display section 6 is connected to the system bus 79, and a liquid crystal display monitor 122 is connected to this controller 88 so as to display a video image of a software watch such as brand watch or fashion watch based on video image information. In this example as well, a data row multiplied in a vertical blanking period of a data broadcast signal employed at the broadcast station 9 is received in the tuner 55 so as to download this data row in the flash memory 33.

An audio processing section 7 reproduces and amplifies a time indicating sound according to the watch information contents D1, and outputs an audio signal to the speaker 77. In the case where a telephone function is selected, it functions as a telephone receiver. A microphone 78 is connected to this audio processing section 7. In the case where the telephone function is selected, it functions as a telephone transmitter.

A communication modem 22 is connected to this microcomputer 90 through the system bus 79, and is connected to a wireless base station, Internet, a telephone line, a satellite line and the like. Data is transmitted and received by these communication lines in the case where a general telephone function is executed or in the case where the watch information contents D1 are downloaded by using the existing communication infrastructure and at the time of settlement of charged contents. A group of data rows received by this communication modem 22 is temporarily stored in the flash memory 33.

Figure 16:
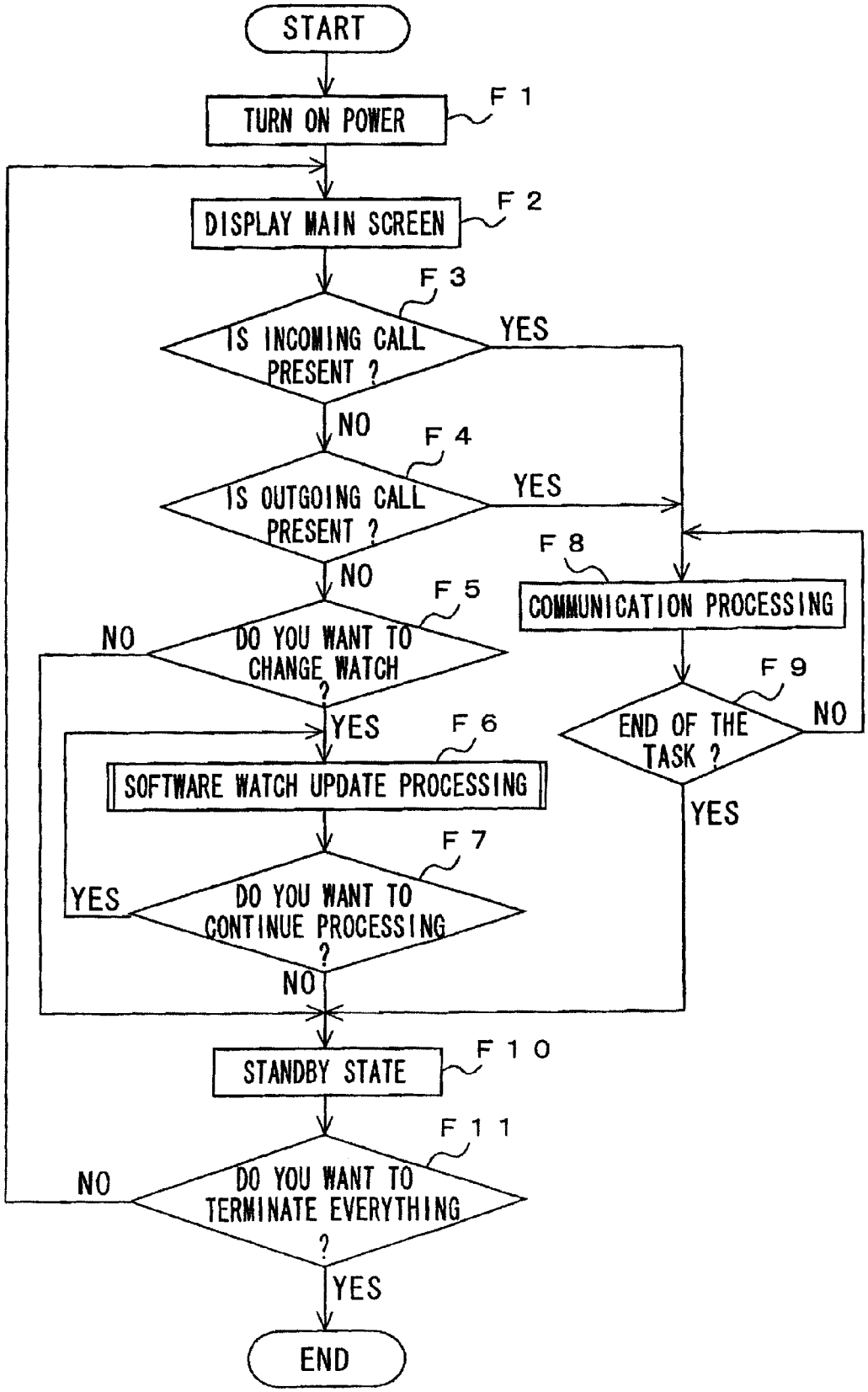
FIG. 16 is a flow chart showing a processing example of the hand held terminal device 401.

Now, a processing example of the hand held telephone set 401 in the software watch system 102 will be described here. FIG. 16 is a flow chart showing a processing example of the hand held telephone set 401.

In this example, there is shown a case in which the software watch 1 as shown in FIG. 10D, and this software watch 1 is recreated (changed) at intervals of communication processing. Assume that the memory card 203 is mounted in advance on an external interface 67.

With this being presumed, when the hand held telephone set 401 is powered ON at the step F1 of the flowchart shown in FIG. 16, a main screen is displayed on a liquid crystal display monitor 122 at the step F2.

Then, at the step F3, whether or not there is a message such as E-mail is displayed on the liquid crystal display monitor 122, and the information user checks it. In the case where an arrival is present, processing goes to the step F8 at which communication processing is executed while the communication modem 22 is interposed between the communication provider's server or the like. Then, processing goes to the step F9 at which it is detected by the microcomputer 90 whether or not communication processing terminates. In the case where communication processing does not terminate, the communication processing of the step F8 is continued, a talk end signal is detected, and the communication processing is terminated.

In addition, in the case where there is no message at the step F3, processing goes to the step F4 at which whether or not a message is delivered from the hand held telephone set 401 to the remote terminal device is displayed on the liquid crystal display monitor 122. In the case where the message is delivered to the remote device, processing goes to the step F8 at which communication processing is executed, the end of communication processing is detected at the step F9, and processing goes to the step F10.

In the case where no message is delivered to the remote device at the step F4, whether or not to change the software watch 1 is displayed on the main screen at the step F5. In the case where the software watch 1 is not changed, processing goes to the step F10. In the case where the software watch 1 is changed at the step F5, processing goes to the step F6 at which update processing of the software watch 1 is done. Here, the watch information contents D1' are read out from the memory card 203 by means of the microcomputer 90.

Then, when the information user operates the operating key 32, a control command is provided to the microcomputer 90 based on operational information D3 caused by this operating key 32 so as to display an example of watch information contents as described in FIG. 7 on the liquid crystal display monitor 122 based on video image information. The audio processing section 7 reproduces and amplifies a sample sound such as time indicating sound, and the audio signal is outputted to the speaker 77. Reference should be made to FIG. 12 for a change example of these software watches 1.

Then, processing goes to the step F7 at which it is checked whether update processing of the software watch 1 is continued or the processing is exited. In the case of exiting the update processing, processing goes to the step F10. At the step F10, the hand held telephone set 401 is established in a standby state. Then, processing goes to the step F11 at which it is checked whether or not all processes are terminated. In the case where these processes are not terminated, processing reverts to the step F2 at which a main screen is displayed on the liquid crystal display monitor 122. In the case where all the processes are terminated, power OFF information or the like is detected, and control processing in the hand held telephone set 401 is terminated.

In this way, in a software watch system 102 according to the second example of the present invention, there is used a memory card 203 having recorded therein watch information contents D1' concerning a variety of clocks. Moreover, the information user wears the memory card 203 on the hand held telephone set 401, and freely combines watch information contents D1' concerning a variety of clocks with each other in an unreal time (asynchronously), thereby making it possible to construct a software watch 1 such as brand watch or fashion watch.

Therefore, a variety of software watches 1 can be displayed on the liquid crystal display monitor 122 based on watch information contents D1', there is no need to physically own a number of wristwatches thus making it possible to improve convenience in view of cost efficiency, management, or space reduction. In addition, in the case where these software watches 1 are used, physical replacement such as a real wristwatch or the like of a conventional system cannot be eliminated. In addition, there is no need for one to directly wear a real wristwatch around one's arm. Thus, the wristwatch does not block manual work, is not damaged, and one does not feel discomfort caused by sweat.

In this system 102, as in the hand held terminal device 14 according to the first example, clock screen information configuring a plurality of software watches 1 may be stored in the hand held telephone set 401, and this clock screen information may be selected to display an arbitrary software watch 1 as a video image so as to clock a time. The information user can select one software watch 1 from among many types by simple information operation. Thus, the user can use a preferable software watch 1 according to the time, the place and the occasion or can enjoy the software watch 1 freely according to the preference.

Further, in this system 102, a time correction program PG can be downloaded in a real time by using the tuner 55 or communication modem 22 so that the time of the software watch 1 can be automatically adjusted at the same time as this downloading.

THIRD EXAMPLE

Figures 17A, 17B:
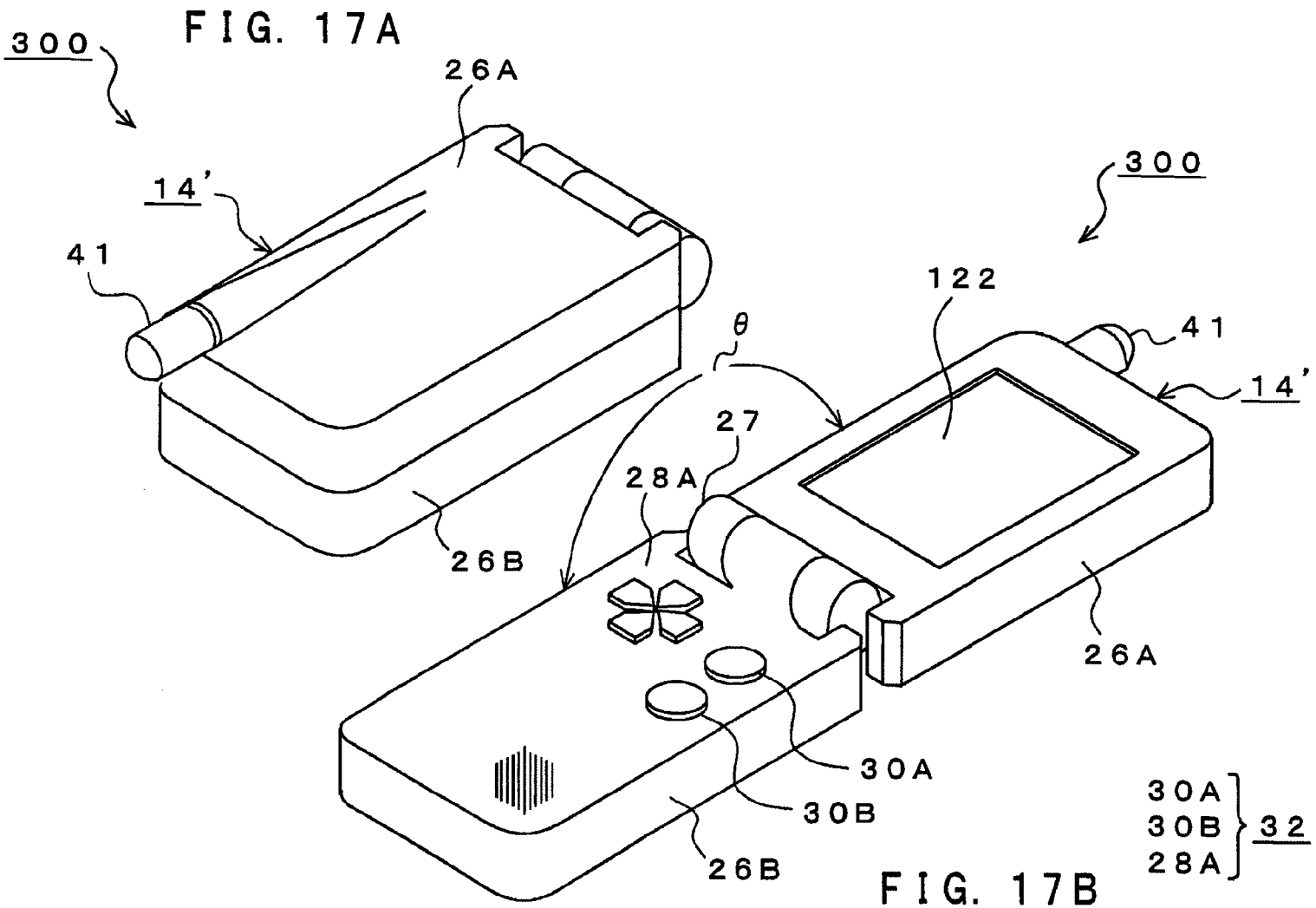
FIG. 17A and FIG. 17B are perspective views each showing an exemplary configuration of a hand held terminal device 14' applied in a software watch system 300 according to a third example of the present invention.

FIG. 17A and FIG. 17B are perspective views each showing an exemplary configuration of a hand held terminal device 14' applied in a software watch system 300 according to a third example of the present invention.

In this system 300, a foldable hand held terminal device 14' as shown in FIG. 17A and FIG. 17B is prepared so as to arbitrarily adjust an opening angle of the hand held terminal device 14' that displays a clock screen according to a software watch and use the software watch as a placement clock.

The hand held terminal device 14' in its retracted state is shown in FIG. 17A. In general, when one carries the hand held terminal device 14', the terminal device is kept to be retracted. FIG. 17B shows an example when the hand held terminal device 14' in its retracted state is opened. The hand held terminal device 14' shown in FIG. 17B has a liquid crystal display main body section 26A consisting of a cover body and an operating main body section 26B consisting of its main frame. This hand held terminal device 14' is designed to be foldable. When one looks at the liquid crystal screen or operates buttons or the like, as shown in FIG. 17B, the liquid crystal display main body section 26A is used to be fully opened.

These liquid crystal display main body section 26A and the operating main body section 26B are movably engaged with each other by means of a hinge member 27. The hinge member 27 has a mechanism for holding a liquid crystal display main body section 26A at an arbitrary angle relevant to the operating main body section 26B by greatly designing a frictional coefficient of the axial section. With this mechanism, the liquid crystal display main body section 26A is locked even at an intermediate position of the open or closed state. Here, an opening angle between the liquid crystal display main body section 26A and the operating main body 26B is defined as $\theta$.

A liquid crystal display monitor 122 is provided at this liquid crystal display main body section 26A so as to display a software, watch video image or an advertisement video image. This liquid crystal display monitor 122 has a color liquid display screen of 320 pixels×240 pixels, for example. Apart from the liquid crystal display monitor 122, an antenna 41 is mounted on a liquid crystal display main body section 26A so that watch information contents D1 can be downloaded from the existing broadcast infrastructure.

Two determination keys 30A and 30B and a cross key 28A configuring operating keys 32 are provided at an operating main body section 26B and are operated so as to input operational information such as information for stopping a time indicating sound. The determination key 30A functions as a power switch of the hand held terminal device 14' as well. With respect to an exemplary internal configuration of this hand held terminal device 14', the substantially same circuit configuration as that of the hand held terminal device 14 shown in FIG. 8 is employed except that the device is equipped with the tuner 55 shown in FIG. 15. Thus a description of such configuration is omitted here.

In this software watch system 300, a configuration similar to that of the hand held terminal device 14 shown in FIG. 8 may be provided without being equipped with the tuner 55. In this case, an antenna 41 is not mounted.

Figure 18:
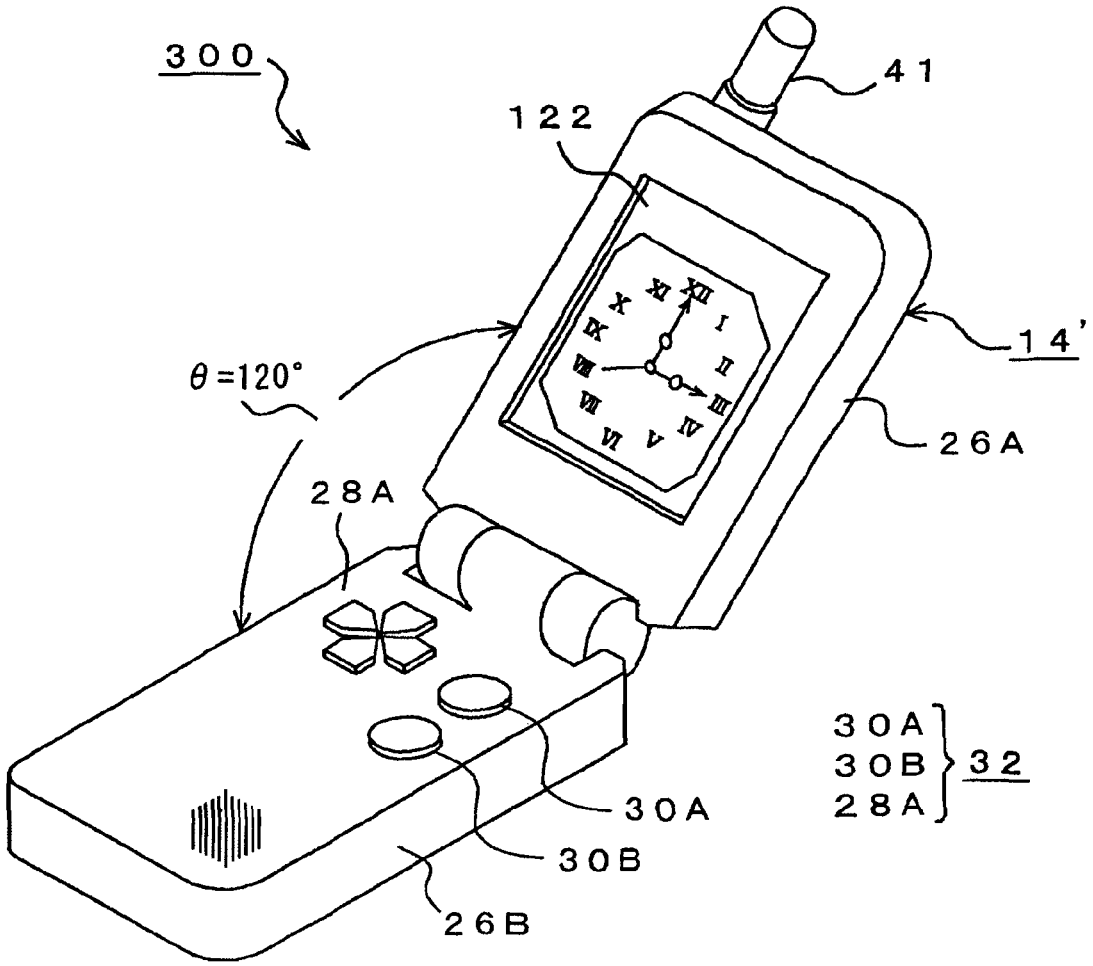
FIG. 18 is a perspective view showing an example of handling of the hand held terminal device 14'.

FIG. 18 is a perspective view showing an example of handling the hand held terminal device 14' in the software watch system 300. FIG. 18 shows an example when the hand held terminal device 14' is used at an opening angle θ=120 degrees. In this example, from analog watch information content example D1 shown in FIG. 7, an item "plain" is described as character board background information D113, an "octal shape" is described as clock frame information D110, Roman numerals I to XII are described as character board information D111, and the "line with a circle" shaped longer and shorter indicators and the "linear" shaped second indicator are described as the indicator shape information D112 in combination.

In this manner, this software watch can be used as a clock (placement clock) as well as watch (wristwatch). Thus, there is no need to own a number of placement clocks. A personal basically needs only one clock so as to use the hand held terminal device 14' that one always carries as a watch or clock. For the shape of use of a placement clock, the watch information contents may be easily visible from a slightly distant place so as to increase a time display itself.

In this system 300 as well, a change in character board background video image can be provided by year, date or time according to watch information contents D1 incorporated in the hand held terminal device 14'. For example, a seasonal background graphics is displayed according to seasons, and graphics such as early afternoon landscape or evening landscape is displayed according to time. Therefore, a character board background video image adapted to the time interval can be automatically displayed, and thus, the feeling of time or feeling of season can be performed.

In this example, watch information contents D1 are daily distributed from the information provider to the information user's hand held device 14' by using a broadcast infrastructure so that a design on a clock screen according to a software watch 1 in this hand held terminal device 14' may be automatically updated daily. As a result, update of the software watch 1 in the information user can be eliminated.

In addition, in distributing watch information contents D1, arbitrary advertisement information and associated additional information that is watch information contents D1 distributed as data or to be on sales are distributed at the same time so that such associated additional information may be displayed at a portion of the clock screen managed by the hand held terminal device 14'.

In this manner, the system 300 can be used as new advertisement media or information media. In the case where the wristwatch OSD information is distributed as data by using a broadcast or communication infrastructure, the advertisement information can be displayed at a portion of the software watch 1. Therefore, the system 300 can be used as advertisement media such as Internet banner advertisement or as new notification media for wristwatch OSD information commodities (distribution and package).

FOURTH EXAMPLE

Figure 19:
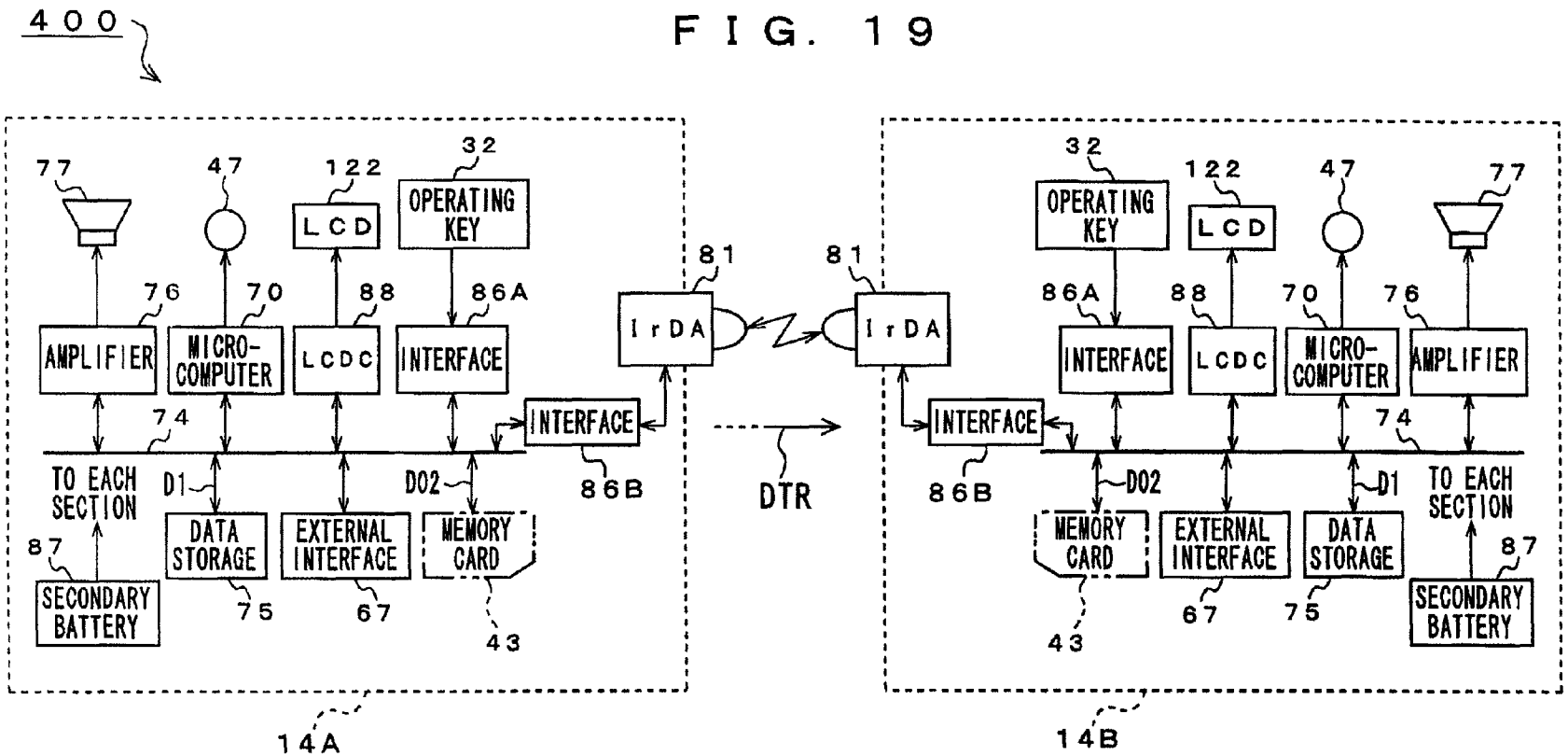
FIG. 19 is a block diagram depicting an exemplary configuration of connection in the hand held terminal devices 14A and 14B applied in a software watch system 400 according to a fourth example of the present invention.

FIG. 19 is a block diagram depicting a connection example of hand held terminal devices 14A and 14B applied in a software watch system 400 according to a fourth example of the present invention. In this system 400, a short distance wireless communication processing is carried out between two hand held terminal devices 14A and 14B, thereby obtain time synchronization.

Infrared-ray wireless communication means (IrDA) 81 is provided at each of the hand held terminal devices 14A and 14B shown in FIG. 19 so as to carry out infrared-ray short distance wireless communication processing between the hand held terminal devices 14A and 14B.

IrDA81 is connected to an interface 86B so that timing information concerning a standard time managed by a microcomputer 70 is delivered as an infrared-ray according to operation of an operating key 32. The operating key 32 is connected to an interface 86A. The same reference numeral and element as those of the hand held terminal device 14 have like functions. Thus a description is omitted here.

This infrared-ray short distance wireless communication processing is done so as to obtain synchronization of date or time in two hand held terminal devices 14A and 14B. For the purpose of this synchronization, for example, when the hand held terminal device 14A provided as a standard is set as a master device, and the hand held terminal device 14B that is time adjustable is set as a slave device, timing information DTR is transferred from the master device to the slave device. In the slave device, the timing information managed by means of the microcomputer 70 is rewritten into timing information DTR from the master device. In this manner, both of these devices are synchronized with each other at a standard time. The short distance wireless communication means may be provided as electric waves or the like without being limited to infrared rays.

In addition, downloading (copy) of the wristwatch OSD information or the like between both of the hand held terminal devices 14A and 14B cannot be carried out in principle. This prevents illegal copy of the sold watch information contents D1 or D1'. When the watch information contents D1 are first downloaded, an ID code specific to the hand held terminal device 14A is incorporated by interleaving the watch information contents D1, and the incorporated code is stored in the data storage 75 or flash memory 33. Therefore, although one own hand held terminal device 14 or the like can release this interleave, the other device cannot release the interleave and disables copying because the ID code is different.

(2) Second Embodiment

Figure 20:
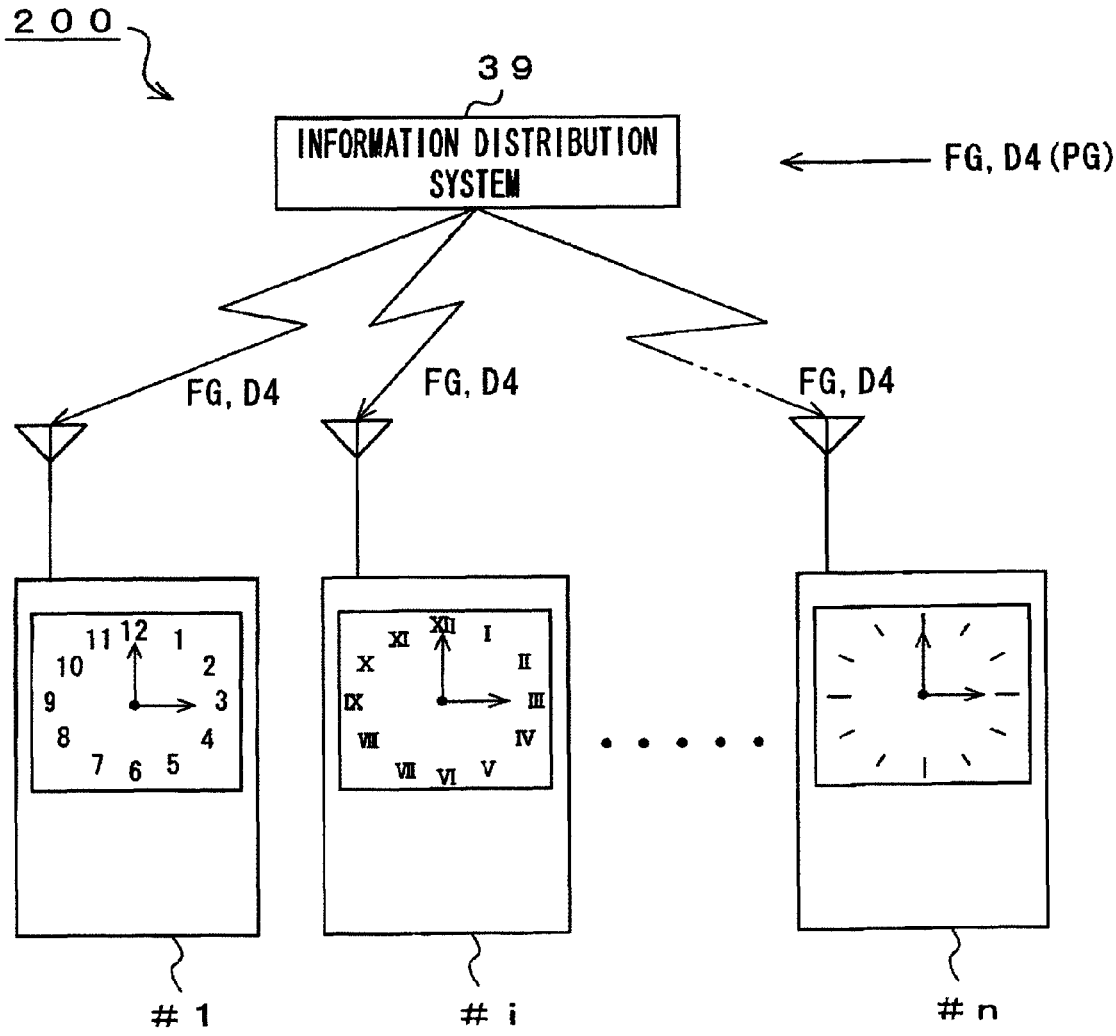
FIG. 20 is a block diagram depicting an exemplary configuration of a watch information content distribution processing system 200 according to the second embodiment of the present invention.

FIG. 20 is a block diagram depicting an exemplary configuration of a watch information content distribution processing system 200 according to a second embodiment of the present invention.

In the present embodiment, in the case where current time information concerning a software watch is distributed and information processed, each hand held terminal device with its communication function triggers correction startup information that has been distributed as data so as to start up a time correction program and correct time of the software watch based on the current time information. In this manner, the time of the software watch and reference time or the like can be automatically coincident with each other, and the convenience of the software watch can be improved more remarkably.

The watch information content distribution processing system 200 shown in FIG. 20 is provided as a system for distributing and information processing the current time information concerning a software watch. The current time information is obtained as real time information, and a data group concerning automatic time correction is received through a communication function of a hand held terminal device #i.

In this system 200, an information distribution system 39 is provided, the current time information D4 is managed, and at least correction startup information FG and current time information D4 are distributed as data according to the information user's request. A clock with its high precision, for example, is prepared for the information distribution system 39 so that a reference time is generated by clocking the standard time in Japan. This reference time is provided as the current time information D4 to the information user.

In this system 200, a plurality of hand held devices #i (i=1 to n) with communication functions are prepared, and correction startup information FG distributed as data from this information distribution system 39 is triggered to start up a time correction program so as to correct the time of the software watch based on the current time information. The communication function may include a wire or wireless function.

This hand held terminal device #i incorporates a time correction program PG described in the first embodiment. In the case where the terminal device does not incorporate such a time correction program PG, the current time information D4, correction startup information FG, and time correction program PG may be distributed from the information distribution system 39 to the hand held terminal device #i.

With respect to time correction of the software watch in this system 200, a manual time correction mode or an automatic time correction mode is set at the hand held terminal device #i.

The manual time correction mode denotes an operation for instructing time correction at an arbitrary timing. This manual time correction mode permits the same operation as a case in which one makes a phone call to 117 in general, thereby making time correction. The automatic time correction mode denotes an operation for making automatic time correction under the preset correction conditions. This automatic time correction mode includes an intermittent automatic time correction mode for making time correction at least in units of time, date, weeks, month, and year.

For example, with respect to the intermittent automatic time correction mode, there are many cases including a case where the hand held terminal device #i is powered ON or OFF, a case of E-mail transmission or reception, once a day, once a month, and a case for battery charge. Once the automatic time correction mode has been set, unless the setting is released, there is no worrying about time correction operation if power is supplied.

Figure 21:
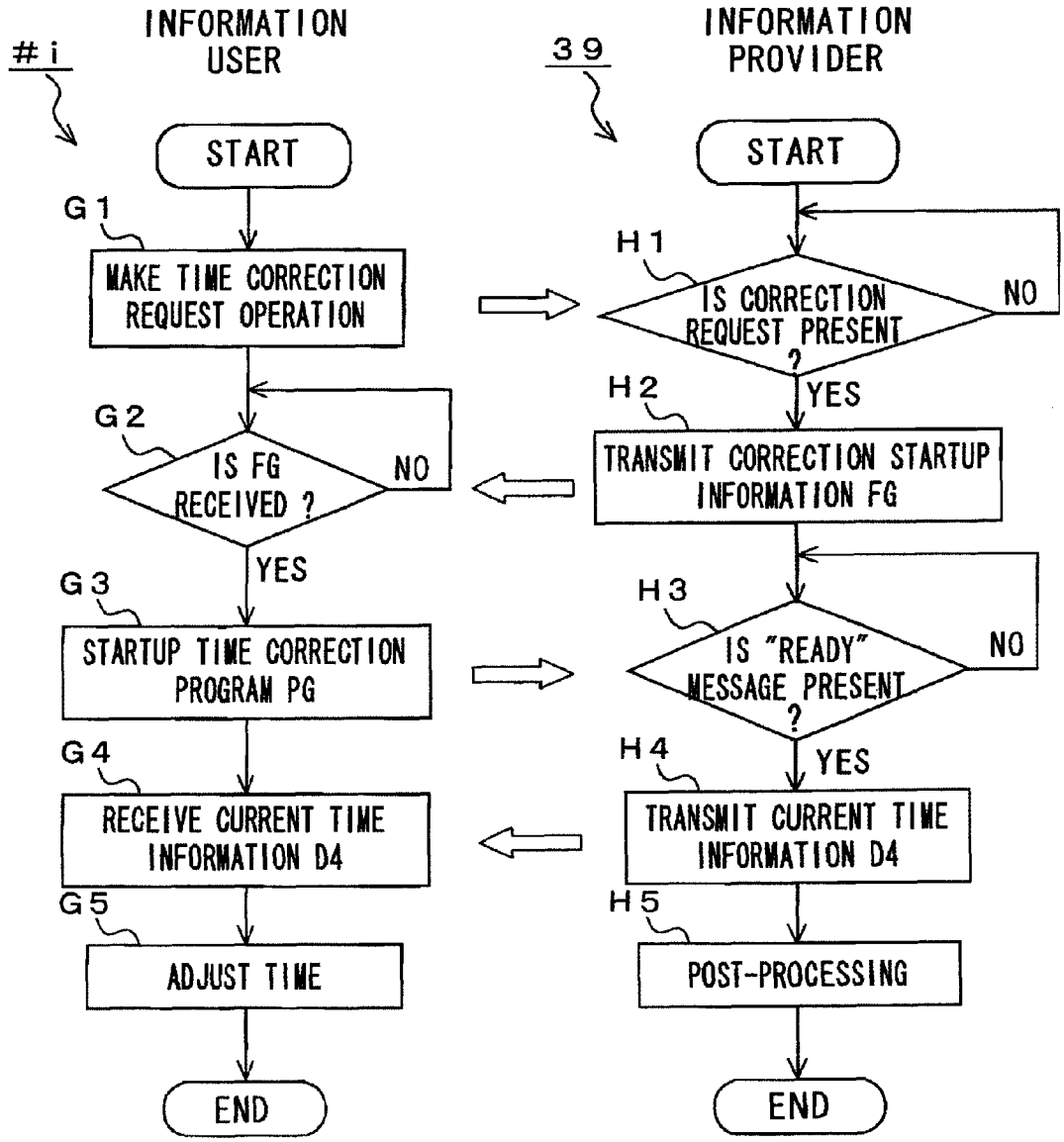
FIG. 21 is a flow chart showing a processing example of the watch information content distribution processing system 200.

Now, a processing example of the watch information content distribution processing system 200 will be described here. FIG. 21 is a flow chart showing a processing example of the watch information content distribution processing system 200.

This system 200 assumes a case in which the current time information D4 concerning a software watch is information processed. The information provider assumes a case in which the current time information is managed; and at least correction startup information FG and current time information D4 are distributed as data to the information user's hand held terminal #i according to the information user's request. The information user assumes a case in which the correction startup information FG distributed as data is triggered to start up a time correction program, and the time of the software watch is corrected based on the current time information D4. The information distribution system 39 and hand held terminal device #i are provided to carry out communication processing in an interactive manner.

With these being defined as processing conditions, at the step G1 of the flow chart shown in FIG. 21, the information user operates the hand held terminal device #i, and makes a time correction request for the information distribution system 39. The time correction request is notified to the information distribution system 39 by using a communication function, for example, a wireless communication function.

When the information provider receives a time correction request by the information distribution system 39 at the step H1, processing goes to the step H2 at which the correction start information FG is provided so as to be transmitted to the hand held terminal device #i. This correction startup information FG is received by the information user's hand held terminal device #i at the step G2. Then, processing goes to the step G3 at which the hand held terminal device #i triggers the correction startup information FG, the time correction program PG is started up, and a ready information is transmitted to the information distribution system 39.

When this ready information is received by the information distribution system 39 at the step H3, processing goes to the step H4 at which the current time information D4 is transmitted to the hand held terminal device #i. This current time information D4 are received by the hand held terminal device #i at the step G4. Then, at the information user side, processing goes to the step G5 at which time is automatically clocked in the hand held terminal device #i.

In this system 200, in distributing the current time information D4, post-processing is done at the step H5. This post-processing is done so as to distribute associated additional information or the like at the same time. The associated additional information is provided as arbitrary advertisement information or watch information contents to be distributed as data or to be on sale. Upon the receipt of this, at a time when time clocking terminates at the information user side at the step G5, the associated additional information such as advertisement information is displayed at a portion of a clock screen, for example, managed by the hand held terminal device #i. Post-processing includes user access database record/update processing without being limited to such additional information.

In this way, in the watch information content distribution processing system 200 according to the second embodiment of the present invention, in the case where the current time information D4 concerning a software watch is distributed and information processed, when the information user operates the hand held terminal device #i, and makes a time correction request for the information distribution system 39, such time correction request is notified to the information distribution system 39 by using the wireless communication function or the like.

Therefore, the hand held terminal device #i triggers the correction startup information FG so that the time correction program PG is started up, and the time of the software watch can be automatically adjusted to the reference time or the like with high precision. In this manner, the convenience of the software watch is improved more remarkably.

FIRST EXAMPLE

Figure 22:
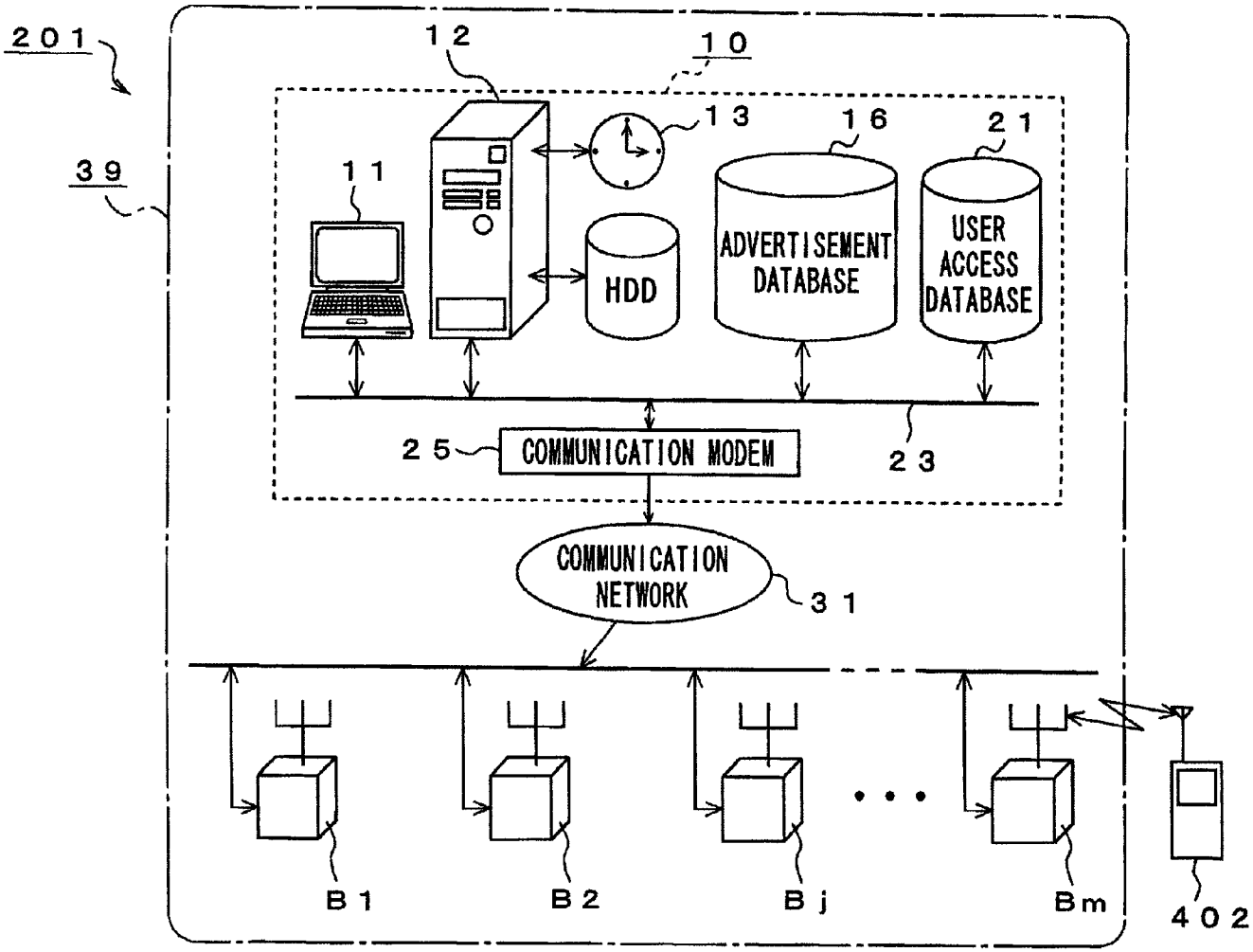
FIG. 22 is a block diagram depicting an exemplary configuration of an automatic time correction processing system 201 according to the first example of the present invention.

FIG. 22 is a block diagram depicting an exemplary configuration of an automatic time correction processing system 201 according to a first example of the present invention.

In this example, the information distribution system 39 is constructed by the dedicated time correcting/managing device 10 and the existing communication infrastructure. The current time information concerning a software watch is distributed to a hand held telephone set provided as an example of a hand held terminal device with its communication function. The correction startup information distributed as data is triggered, thereby starting up a time correction program so as to correct the time of the software watch base on the current time information.

The automatic time correction processing system 201 shown in FIG. 22 is provided as a system for distributing and information processing the current time information (hereinafter, referred to as the current time data) D4 concerning a software watch. This system 201 is equipped with the information distribution system 39. The information distribution system 39 is composed of a dedicated time correcting/managing device 10, an existing communication network 331, and a plurality of wireless base stations Bj (j=l to m).

The time correcting/managing device 10 is disposed by a specific communication provider so as to manage the current time data D4 and distribute at last correction startup information FG (hereinafter, referred to as a correction trigger flag) and current time data D4 according to the information user's request.

In addition, the time correcting/managing device 10 has a communication line 23 such as LAN and a communication modem 25. The communication line 23 is connected to the communication modem 25, and is connected to the existing communication network 31. The time correcting/managing device 10 is provided with a management terminal device 11, a server main body 12, a high precision clock 13, a hard disk (HDD) 15, an advertisement database 16, and a user access database 21 other than the communication line 23 and communication modem 25. These elements are connected via the communication line 23.

The management terminal device 11 is provided so as to receive the information user's time correction request concerning a software watch. The server main body 12 is connected to the management terminal device 11 through the communication line 23. The high precision clock 13 and hard disk 15 are connected to the server main body 12, and the standard time in Japan is clocked, thereby to generate a reference time. This reference time is provided as the current time data D4 to the information user in a real time.

Associated additional information such as arbitrary advertisement information or watch information contents to be distributed as data or to be on sale is provided so as to be stored in an advertisement database 16 connected to this communication line 23. This is because such associated additional information can be distributed together with the current time data D4 at the same time. An advertisement effect on a new software watch or an advertisement effect of the system 200 can be increased by distribution of the associated additional information.

Further, the information user who has made a time correction request is to be registered in a user access database 21, for example. It is also preferred to register an information user who has made a request for setting an automatic time correction mode. For after-service in future, the database contents are to be updated.

A Plurality of wireless base stations Bj (j=l to m) which is an example of wireless communication means is connected to the communication network 31, and the information user's request is received and the correction trigger flag FG and the correct time data D4 outputted from the time correcting/managing device 10 according to this request so as to be distributed as data to the information user's hand held telephone set 402. A wireless base station Bj can be applied as a base station using wireless electric waves of the existing use frequency interval.

Figure 23:
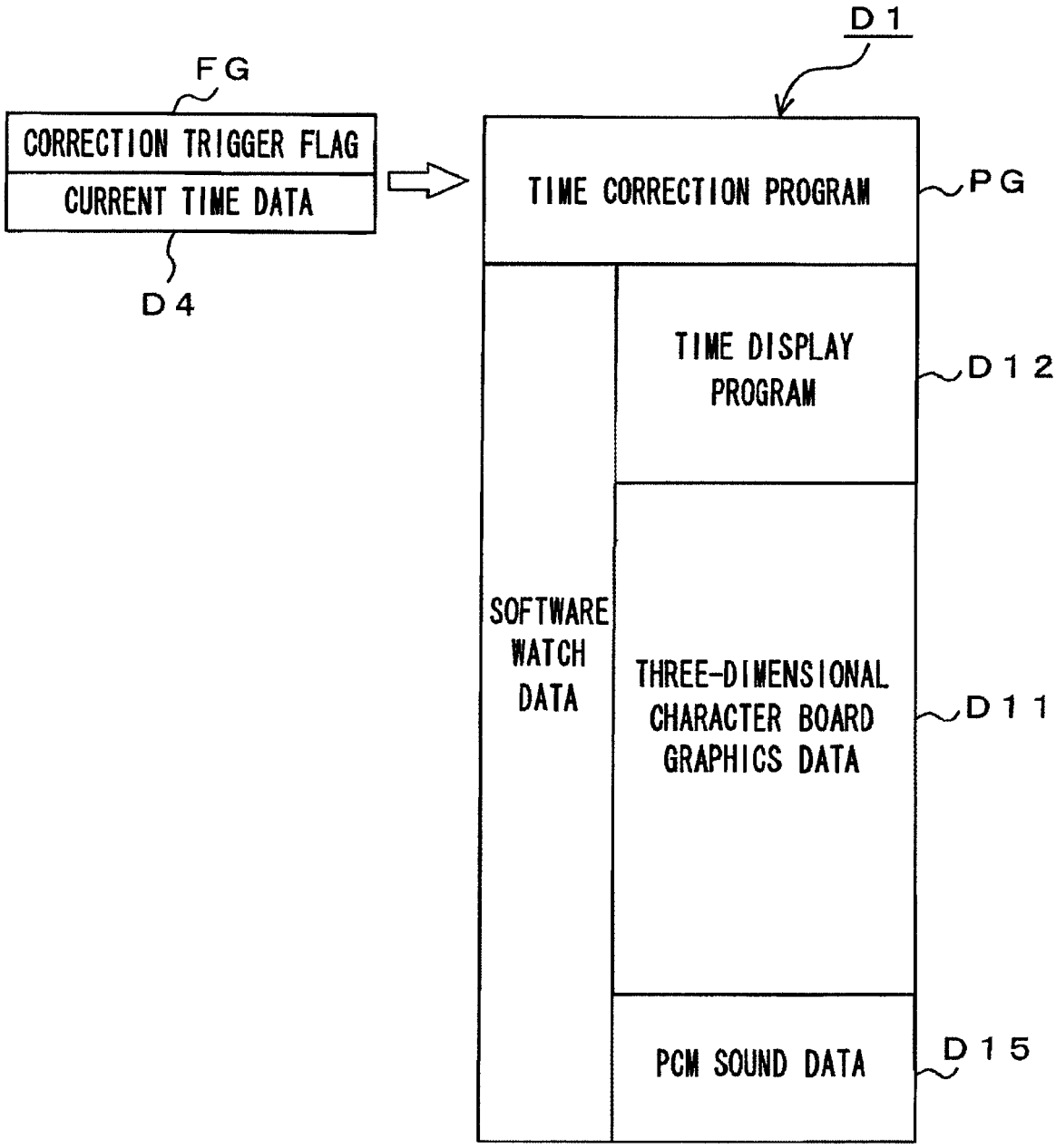
FIG. 23 is an imaginary view showing an exemplary configuration of data for automatic time correction in the automatic time correction processing system 201.

Now, an exemplary configuration of automatic time correction data in the automatic time correction processing system 201 will be described here. FIG. 23 is an imaginary view showing an exemplary configuration of automatic time correction data in the automatic time correction processing system 201.

The watch information contents D1 shown in FIG. 23 are obtained as data for operating a software watch. The contents are distributed as data by using the existing communication infrastructure or the like, or are provided as a memory card by means of a memory card provided as an example of a recording medium. The watch information contents D1 are composed of the time correction program PG and software watch data. The watch information contents D1 is provided so as to be stored in the nonvolatile memory in the hand held telephone set 402.

In this example, the time correction program PG is provided as a program mounted on the hand held telephone set 402, the program correcting the current time. This program PG is started up by triggering the correction trigger flag FG so as to correct the current time based on the current time data D4. The correction trigger flag FG and current time data D4 are prepared in the information distribution system 39 so as to be distributed as data according to the information user's request.

The software watch data is composed of: a time display program provided as an example of clock display data D12; three-dimensional character board graphics data provided as an example of character board information D11; and PCM sound data D15 such as time indicating sound in the same way as that in the first embodiment.

Figure 24:
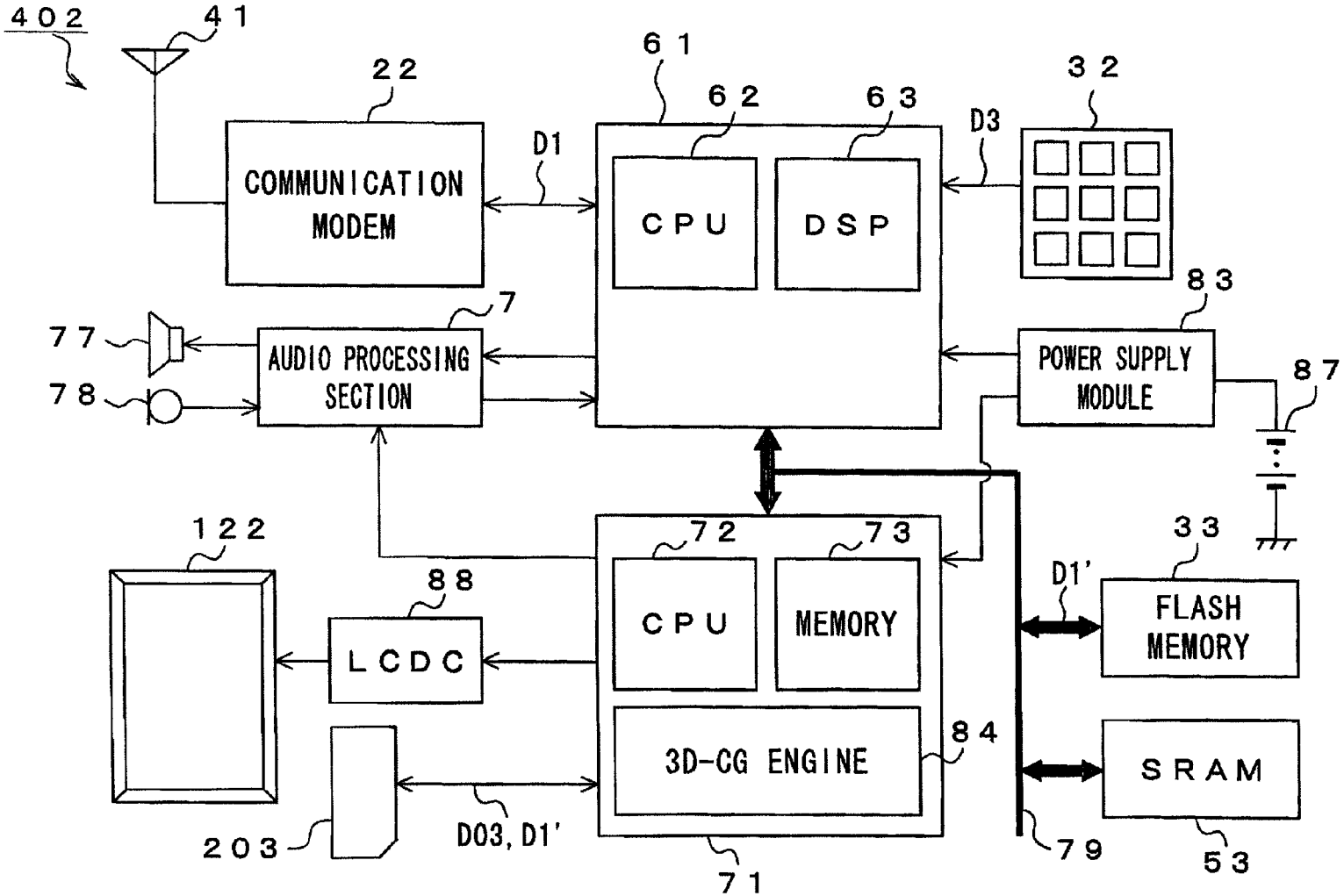
FIG. 24 is a block diagram depicting an exemplary configuration of a hand held telephone set 402 in the automatic time correction processing system 201.

Now, an exemplary configuration of a hand held telephone set 402 in an automatic time correction processing system 201 will be described here. FIG. 24 is a block diagram depicting an exemplary configuration of the hand held telephone set 402 in the automatic time correction processing system 201 according to one example of the present invention.

The hand held telephone set 402 shown in FIG. 24 is provided as an example of a second hand held terminal device so as to acquire and process watch information contents D1 concerning a software watch as described in the first embodiment. In the hand held telephone set 402, a communication request is made to a specific communication provider in the system 201. In addition, the current time data D4 and correction trigger flag FG are received from such a communication provider, the correction trigger flag FG starts a time correction program PG, and the time of the software watch is corrected based on the current time data D4.

In the hand held telephone set 402, the same element and reference numeral as the hand held telephone set 401 show in FIG. 15 have like functions. Thus a description is omitted here. In the hand held telephone set 402, a tuner is omitted as compared with the first embodiment.

This hand held telephone set 402 comprises a general telephone function, processes watch information contents D1' or game data D03 and the like from the memory card 203, and has a system bus 79. A flash memory 33, a SRAM 53, a communication chip 61, and a graphics chip 71 or the like are connected to this system bus 79, and these elements are provided to be driven by means of a secondary battery 87 through a power module 83.

Clock screen information configuring a plurality of software watches is provided so as to be stored in the flash memory 33 in the same way as that in the first embodiment. The telephone number information on the hand held telephone set 402, an application program, and time correction program PG or the like are provided so as to be temporarily stored in the SRAM 53.

This hand held telephone set 402 has a communication modem 22 provided as an example of a receiving section so as to receive a correction trigger flag FG and current time data D4. Of course, the communication modem 22 receives watch information contents D1 distributed by using the existing communication infrastructure and has a communication function of a general wireless telephone set.

In addition, in the communication modem 22, in the case where a general telephone function is executed or in the case where the watch information contents D1 are downloaded by using the existing communication infrastructure or at the time of settlement of charged contents, the contents are received through the above described communication network 31, wireless base station Bj and the like. A group of data rows received by this communication modem 22 is provided to be temporarily stored in the flash memory 33.

An antenna 41 is connected to the communication modem 22 so as to transmit wireless electric waves to the wireless base station Bj or receive wireless electric waves from the wireless base station Bj. The wireless base station Bj is connected to a communication network 31 such as Internet, a telephone line, or a satellite line.

A communication chip 61 is connected to the communication modem 22. The communication chip 61 is produced by providing a CPU 62 and DSP (Digital Signal Processor) 63 as one chip in a semiconductor integrated circuit. During normal telephone, a transmission audio signal or the like is digitally processed as code data, and audio code data during reception is digitally processed to be decoded.

An audio processing section 7 is connected to the communication chip 61, the time indicating sound according to watch information contents D1 is reproduced and amplified, and an audio signal is outputted to the speaker 77. In the case where a telephone function is selected, it functions as a telephone receiver. A microphone 78 is connected to this audio processing section 7. In the case where a telephone function is selected, it functions as a telephone transmitter.

An operating key 32 provided as an example of the operating section is connected to the communication chip 61. This key is used for inputting operational information D3 concerning time correction, inputting operational information D3 concerning watch information contents D1, and, of course, inputting a telephone number.

In this example, a manual time correction mode or an automatic time correction mode is set by using the operating key 32. The manual time correction mode or automatic time correction mode is set to a graphics chip 71. The automatic time correction mode includes at least intermittent automatic time correction mode for making time correction in units of time, date, day of the week, month, and year. Of course, in the case of making time correction on the communication chip 61, the setting may be provided to the CPU 62.

A graphics chip (hereinafter, referred to as an application chip) 71 is connected to the above described system bus 79. The graphics chip 71 is provided by producing a CPU 72 provided as an example of a control unit, a memory 73, or 3D-CG engine 84 as one chip in a semiconductor integrated circuit. The CPU 72 starts up a time correction program PG by means of a correction trigger flag FG received by the communication modem 22, and corrects the time of the software watch based on the current time data D4.

The CPU 72 is provided so as to display and control a video image concerning a software watch, the video image consisting of a three-dimensional video image obtained by processing the watch information contents D1. The watch information contents D1 are read out from the flash memory 33. The graphics chip 71 is provided with the memory 73 and a 3D-CG engine 84. This chip configures a data decoder circuit or the like similar to that according to the first embodiment so as to arbitrarily process video image element information and audio information based on the watch information contents D1 (application chip).

In this example as well, there is shown a case in which a memory card 203 provided as an example of an information recording medium is provided to an information user. The information user mounts this memory card 203 on the hand held telephone set 402 so as to use the watch information contents D1 concerning a software watch through a graphics chip 71. A nonvolatile memory such as a flash memory is used for the memory card 203.

Figure 25:
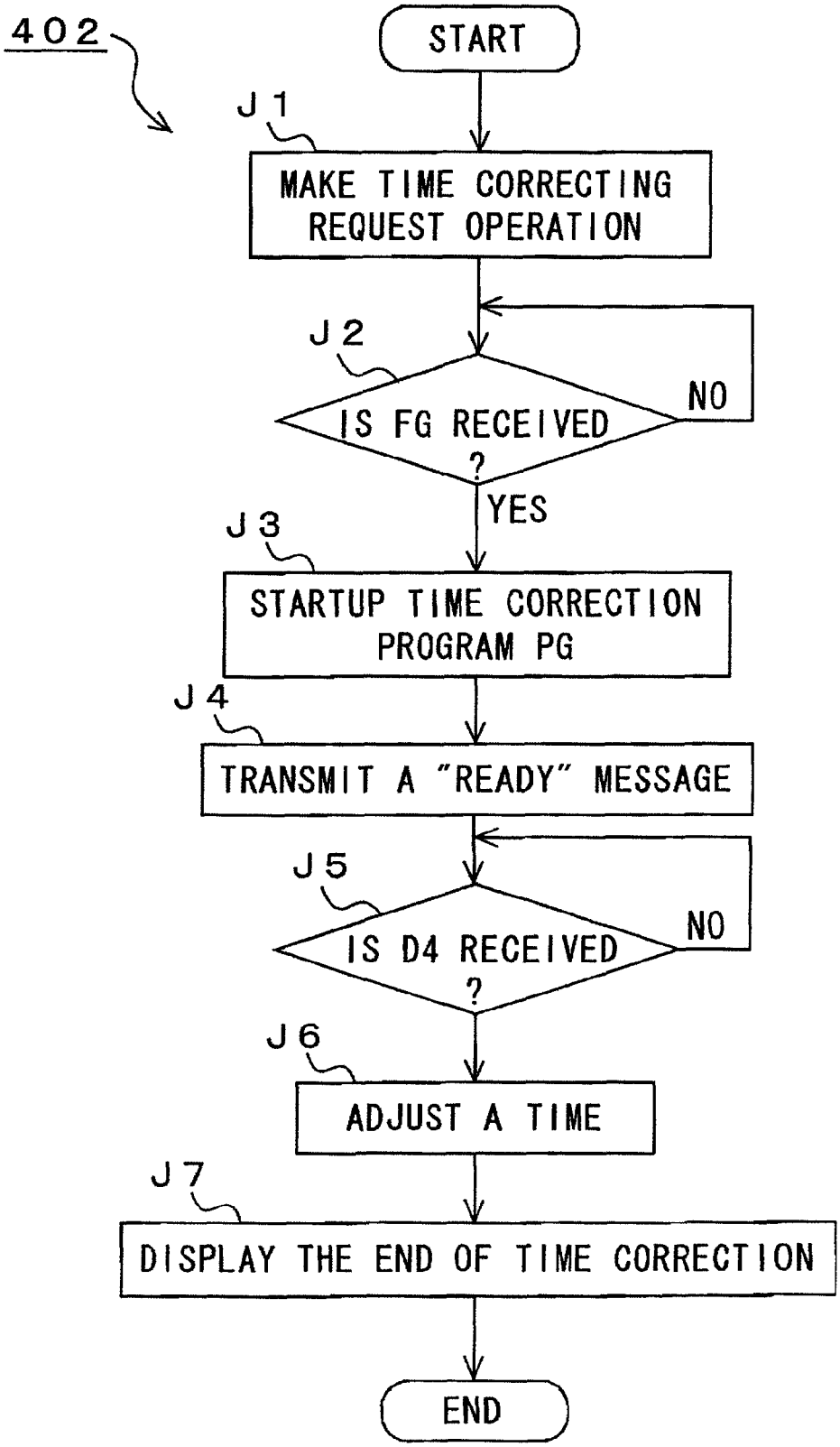
FIG. 25 is a flow chart showing a processing example of the hand held telephone set 402 according to the system 201.

Now, a processing example of an automatic time correction processing system 201 will be described here. FIG. 25 is a flow chart showing a processing example of the hand held telephone set 402. In this example, at least correction trigger flag FG and current time data D4 are distributed according to the information user's request. Then, each hand held telephone set 402 starts up a time correction program by the correction trigger flag FG distributed as data so as to correct the time of the software watch based on the current time data D4. The information distribution system 39 and hand held telephone set 402 are provided so as to be make communication processing in an interactive manner. In this example, a description is given by dividing processing into two processes at the information user and information provider.

[Information User]

The information user operates a hand held telephone set 402, and makes a time correction request for the information distribution system 39 at the step J1 of the flow chart shown in FIG. 25. A time correction request is inputted by using an operating key 32; a wireless base station Bj, a communication network 31, a communication modem 25, and a communication line 23 are connected to each other, and a communication path is established. A time correction request is notified to a time correcting/managing device 10 of the information distribution system 39 by using a wireless communication function. At this time, the information user sets a manual time correction mode, for example. Of course, an automatic time correction mode may be set.

Then, processing goes to the step J2 at which one waits until the correction trigger flag FG has been received. This is because the time correction program PG is started up. After this correction trigger flag FG has been received, processing goes to the step J3 at which the hand held telephone set 402 triggers the correction trigger flag FG, and starts up the time correction program PG.

Then, processing goes to the step J4 at which a "ready" message (status) is provided so as to be transmitted from the hand held telephone set 402 to the information distribution system 39. This is because the acceptance of the current time data is notified to the time correcting/managing device 10. Then, processing goes to the step J5 at which the hand held telephone set 402 waits until the current time data D4 has been received. After this current time data D4 has been received, processing goes to the step J6 at which time is automatically adjusted at the hand held telephone set 402.

For example, in the case where a 3-second gain error occurs between the current time data D4 and the time display data, such 3-second gain error is detected by the CPU 72, and the time display data is adjusted to the current time data D4 so as to eliminate such 3-second gain error. Then, processing goes to the step J7 at which a screen indicating the end of time correction is displayed on a monitor 122. On this time correction completion screen, advertisement information is provided so as to be displayed. At a time when advertisement information is downloaded, the line is turned OFF. At the end of time correction, alarm information may be displayed to be lit on an LED without being limited to such screen display.

In this way, according to the hand held telephone set 402, a time correcting operation can be made at an arbitrary timing so as to automatically adjust the time of the software watch with a very simple operation with high precision. Therefore, the convenience of the software watch is improved more remarkably.

Moreover, if an automatic time correction mode is set, when the setting conditions are established, a communication function automatically accesses the time correcting/managing device 10 and receives precise current time data D4 so as to automatically time correct the software watch in the hand held telephone set 402.

In addition, if an intermittently time correction mode is set, an access is automatically provided to the time correcting/managing device 10 at periodic intervals so that a maximum error in software watch can be restrained to be a predetermined range or less. Therefore, the degree of freedom is increased in selecting a quartz oscillator or the like. In particular, there is no need to mount a reference clock device with high precision, and the manufacturing cost of the hand held telephone set 402 handling a software watch can be reduced.

[Information Provider]

Figure 26:
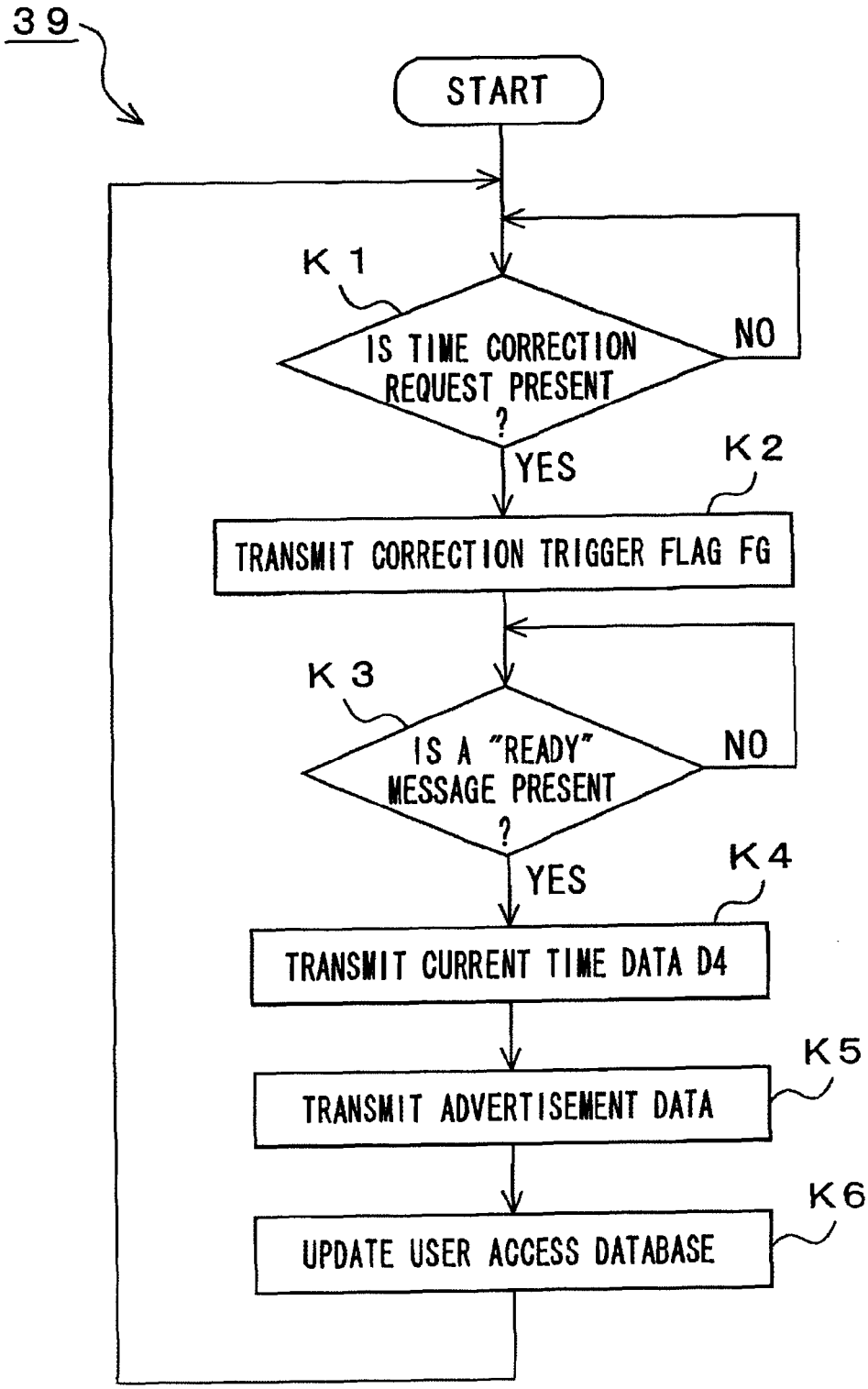
FIG. 26 is a flow cart showing a processing example of an information distribution system 39.

FIG. 26 is a flow chart showing a processing example of the information distribution system 39. The information provider waits for a time correction request from the information user at the step K1 of the flow chart shown in FIG. 26. At this time, the wireless base station Bj receives a request from the information user's hand held telephone set 402. This information user's time correction request is transferred from the wireless base station Bj to the time correcting/managing device 10. When this time correction request is received by the time correcting/managing device 10, processing goes to the step K2 at which the correction trigger flag FG is provided so as to be transmitted from the information distribution system 39 to the hand held telephone set 402 through the wireless base station Bj. This is because the time correction program PG is started up by the hand held telephone set 402.

Then, processing goes to the step K3 at which one waits for a "ready" message from the hand held telephone set 402. This is because the startup of the time correction program PG in the hand held telephone set 402 is checked at the information distribution system 39. When the "ready" message is received at the management terminal device 11, processing goes to the step K4 at which the current time data D4 is transmitted from the server main body 12 to the hand held telephone set 402.

At the server main body 12, the standard time in Japan is clocked by a high precision clock 13, and a reference time is generated. This reference time is provided as current time data D4 to the information user. At this time, at the wireless base station Bj, the current time data D4 outputted from the time correcting/managing device 10 is provided so as to be distributed as data to the information user's hand held telephone set 402.

Then, when the current time data D4 is transmitted, advertisement according to the watch information contents or the like to be newly on sale or advertisement data on other products or the like are read out from an advertisement database 16 at the step K5. The advertisement information read out here is transmitted to the hand held telephone set 402.

Then, processing goes to the step K6 at which a line is disconnected. Then, processing goes to the step K7 at which a user access database 21 is updated. An information user making a time correction request, for example, is registered in this database. In addition, an information user making a request for setting an automatic time correction mode is registered. These registrations are done for after-service provided later. Then, processing reverts to the step K1 at which one waits for a time correction request. This information distribution processing is continued as long as the system 201 is aborted.

In this way, according to an automatic time correction processing system 201 of the first example, the information distribution system 39 is provided, and at least correction trigger flag FG and current time data D4 are distributed according to the information user's request. Thus, the information user can make a time correcting operation at an arbitrary timing. Moreover, the time of the software watch can be automatically adjusted to a reference time or the like with high precision by a very easy operation.

In this manner, in constructing the automatic time correction processing system 201, a reference clock device with its high precision may be mounted on the time correcting/managing device 10, and there is no need to provide the clock device at individual hand held telephone sets 402. This improves the convenience of the software watch more remarkably, and greatly contributes to reduction of the manufacturing cost of the hand held telephone set 402 handling the software watch.

In addition, according to the first automatic time correction system 201, apart from the current time data D4, advertisement information is downloaded at the same time. Thus, the advertisement information can be audio-visually provided on the hand held telephone set 402. The advertisement income can be reduced to an information charge and a communication charge, and these charges can be set inexpensively or free. In addition a new market for advertisement media can be created so that clients according to such advertisement media can be provided.

SECOND EXAMPLE

Figures 27A, 27B:
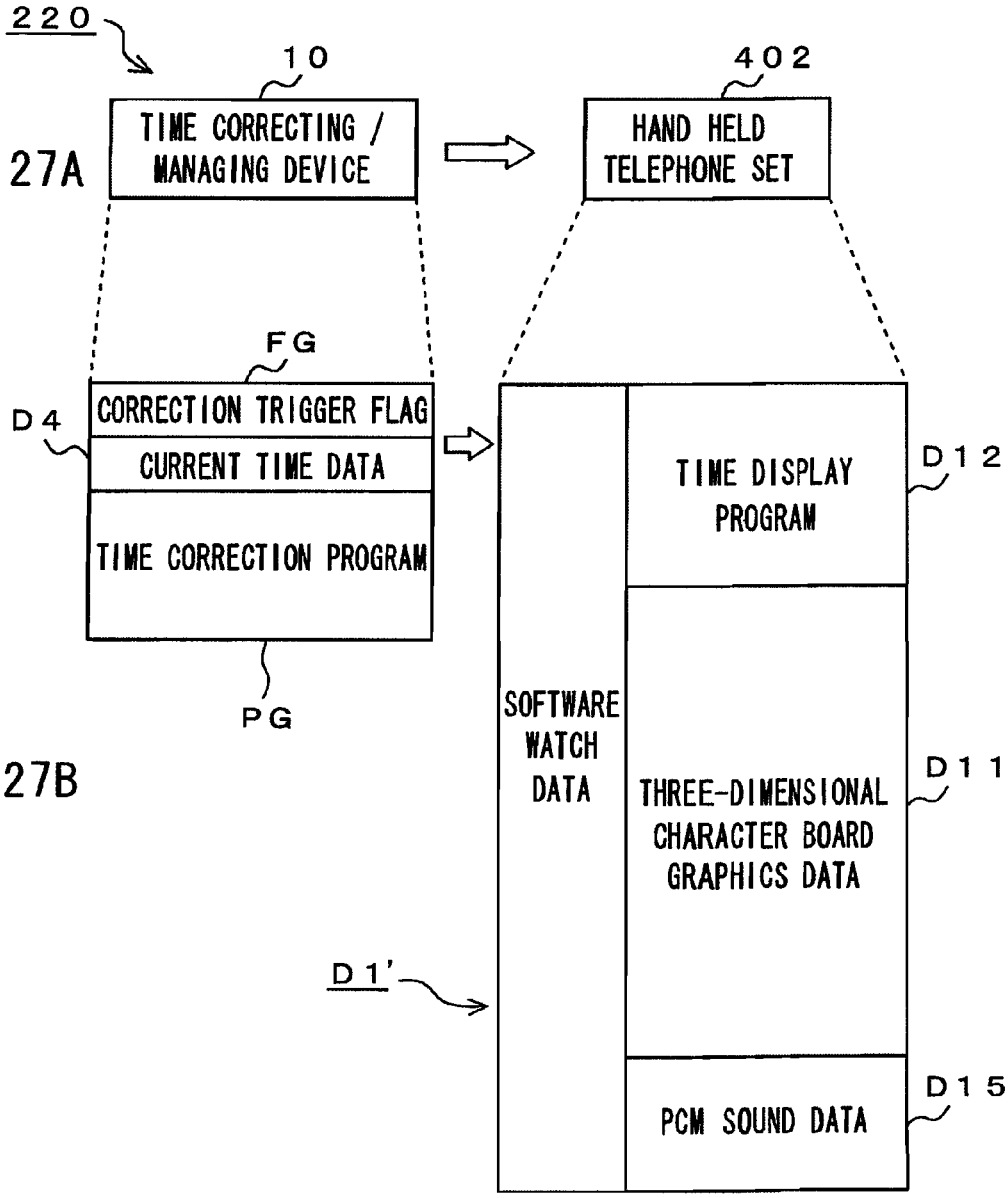
FIG. 27A and FIG. 27B are imaginary views each showing an automatic time correction processing system 220 and an exemplary data structure according to the second example of the present invention.

FIG. 27A and FIG. 27B are imaginary views each showing an automatic time correction processing system 220 and an exemplary data configuration according to a second example of the present invention.

The automatic time correction processing system 220 shown in FIG. 27A is provided as a system for distributing and information processing the current time data D4 concerning a software watch. This system 220 is provided as a system for distributing the time correction program PG as well as the correction trigger flag FG and current time data D4 to the hand held telephone set 402 by means of the time correcting/managing device 10. The same element and reference numeral as those in the first example have like functions. Thus a description is omitted here. In FIG. 27A, the wireless base station Bj and communication network 31 are eliminated.

According to an exemplary data configuration for automatic time correction shown in FIG. 27B, the time correction program PG is provided so as to be operated after downloaded from the time correcting/managing device 10 to the hand held telephone set 402 every time correcting operation instead of first mounting the time correction program PG on the hand held telephone set 402.

By doing this, the time correction program PG can always use the newest version, thus making it easy to improve a software watch or upgrade its function. In addition, an amount of data can be reduced when the software watch is mounted, and an amount of data that resides in the hand held telephone set 402 can be reduced. For example, a memory region of the flash memory 33 can be efficiently used, and the memory capacity can be reduced.

Now, a processing example of the automatic time correction processing system 220 will be described here.

Figure 28:
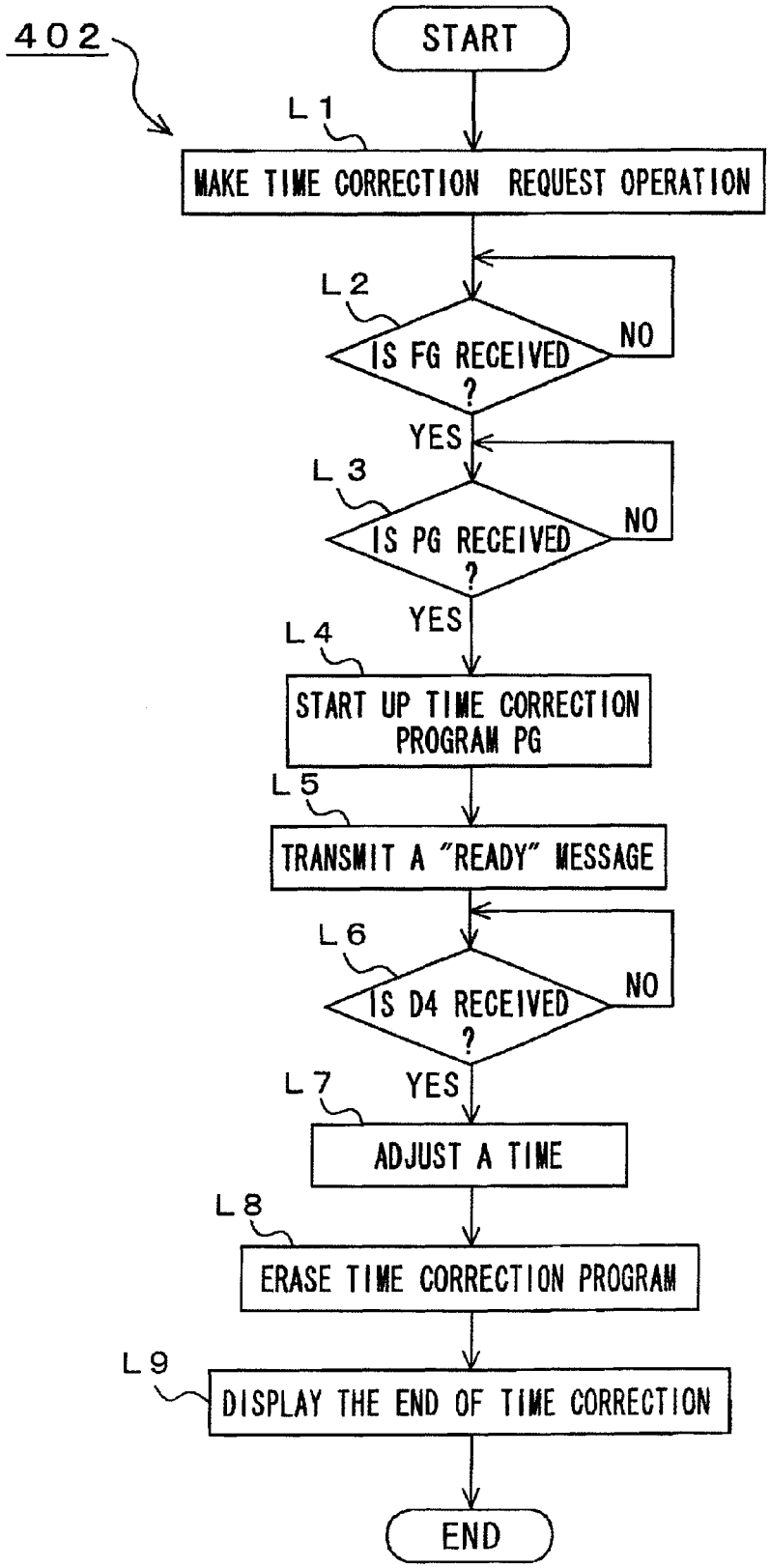
FIG. 28 is a flow chart showing a processing example of the hand held telephone set 402 according to the system 220.

FIG. 28 is a flow chart showing a processing example of the hand held telephone set 402 according to the second example.

In this example, at least the correction trigger flag FG, current time data D4, and time correction program PG are distributed according to the information user's request. In each hand held telephone set 402, this time correction program PG is started up by the correction trigger flag FG distributed as data so as to correct the time of the software watch based on the current time data D4. The time correcting/managing device 10 and hand held telephone set 402 are provided so as to undergo communication processing in an interactive manner. In this example, a description will be given by dividing processing into two processes at the information user and information provider sides.

[Information User]

The information user operates the hand held telephone set 402 at the step L1 of the flow chart shown in FIG. 28, thereby making a time correction request for the time correcting/managing device 10. The time correction request is inputted by using the operating key 32, and the wireless base station Bj, communication network 31, communication modem 25, and communication line 23 are connected to each other (refer to FIG. 22).

The time correction request is notified to the time correcting/managing device 10 by using a wireless communication function. At this time, the information user sets a manual time correction mode, for example. Of course, the user may set an automatic time correction mode.

Then, processing goes to the step L2 at which one waits until the correction trigger flag FG has been received. This is because the time correction program PG is started up. After this correction trigger flag FG has been received, processing goes to the step L3 at which one waits until the time correction program PG has been further downloaded. This is because the time correction program PG does not reside in this example.

After this time correction program PG has been received, processing goes to the step L4 at which the time correction program PG is started up at the hand held telephone set 402. Then, processing goes to the step L5 at which a "ready" message is transmitted from the hand held telephone set 402 to the time correcting/managing device 10. This is because the acceptance of the current time data D4 is notified to the time correcting/managing device 10.

Then, processing goes to the step L6 at which the hand held telephone set 402 waits until the current time data D4 has been received. When this current time data D4 has been received, processing goes to the step L7 at which a time is automatically adjusted in the hand held telephone set 402. Reference should be made to the first example shown in FIG. 25.

Then, processing goes to the step L8 at which the time correction program PG is erased. This is because the time correction program PG is not caused to reside in this example. Then, after the time correction program PG has been erased, processing goes to the step L9 at which a screen indicating the end of time correction is displayed on the monitor 122. Then, advertisement information is provided so as to be displayed on the screen indicating the end of time correction. A line is disconnected at a time when the advertisement information is downloaded.

[Information Provider]

Figure 29:
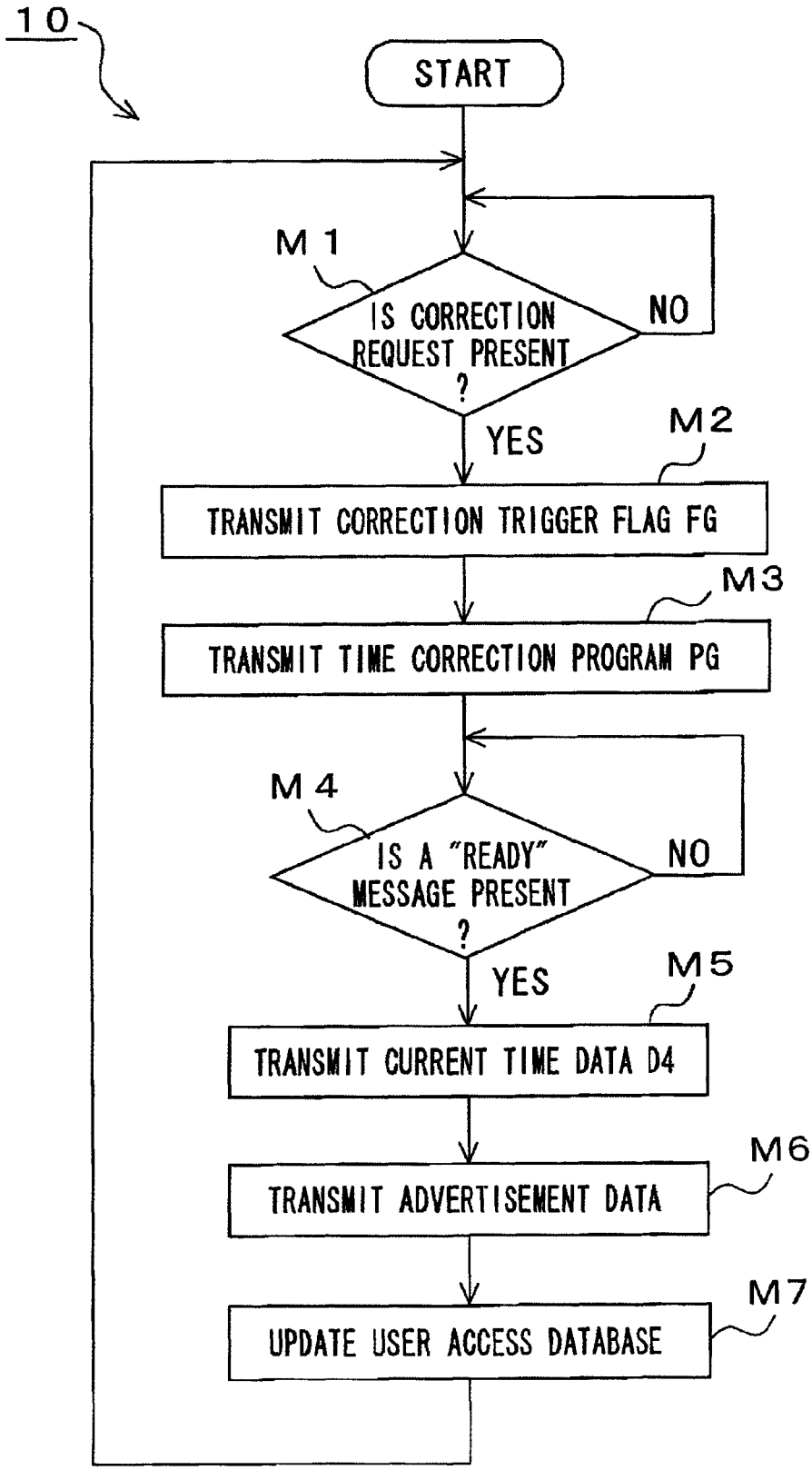
FIG. 29 is a flow chart showing a processing example of a time correction/management device 10.

FIG. 29 is a flow chart showing a processing example of the time correcting/managing device 10. The information provider waits for a time correction request from the information user at the step M1 of the flow chart shown in FIG. 29. At this time, the wireless base station Bj receives a request from the information user's hand held telephone set 402.

This information user's time correction request is transferred from the wireless base station Bj to the time correcting/managing device 10. When this time correction request has been received by the time correcting/managing device 10, processing goes to the step M2 at which the correction trigger flag FG is provided so as to be transmitted from the time correcting/managing device 10 to the hand held telephones set 402 through the wireless base station Bj. Then, processing goes to the step M3 at which the time correction program PG is provided so as to be transmitted.

Then, processing goes to the step M4 at which one waits for a "ready" message from the hand held telephone set 402. This is because the startup of the time correction program PG in the hand held telephone set 402 is checked by the time correcting/managing device 10. When a "ready" message has been received by the management terminal device 11, processing goes to the step M5 at which the current time data D4 is transmitted from the sever main body 12 to the hand held telephone set 402.

At the server main body 12, the standard time in Japan is clocked by the high-precision clock 13, and a reference time is generated. This reference time is provided as the current time data D4 to the information user. At this time, at the wireless base station Bj, the current time data D4 outputted from the time correcting/managing device 10 is provided so as to be distributed as data to the information user's hand held telephone set 402.

Then, in transmitting the current time data D4, advertisement according to the watch information contents or the like to be newly on sale or advertisement data on other products or the like is read out from the advertisement database 16 at the step M6. The thus read out advertisement information is transmitted to the hand held telephone set 402.

Then, after the line has been disconnected, processing goes to the step M7 at which the user access database 21 is updated. In this database, for example, an information user making a time correction request is registered. In addition, an information user making a request for setting an automatic time correction mode is registered as well. These registrations are done for after-service provided later. Then, processing reverts to the step M1 at which one waits for a time correction request. This information distribution processing is continued unless the system 201 has been aborted.

In this way, according to the automatic time correction processing system 220 of the second example, even if the time correction program PG is not caused to reside in the hand held telephone set 402, a time correcting operation can be made at an arbitrary timing. Thus, as in the first example, the time of the software watch can be automatically adjusted to a reference clock or the like with high precision by a very simple operation.

Moreover, a high precision reference clock device may be mounted on the time correcting/managing device 10, and there is no need to provide the clock device at individual hand held telephone sets 402. This improves the convenience of the software watch more remarkably, and greatly contributes to further reduction of the manufacturing cost of the hand held telephone set 402 that handles the software watch as compared with the first example.

In this example as well, apart from the current time data D4, advertisement information is downloaded at the same time, and thus, advertisement information can be audio-visually provided on the hand held telephone set 402. Therefore, as in the first example, the information charge and communication charge can be made inexpensively or free. In addition, a new market for advertisement media can be created.

Although the above described example has described a case in which time correction processing is carried out on the graphics chip 71, time correction processing may be carried out by using a CPU 62 of a communication chip 61 without being limited thereto.

As has been described above, a watch information content distribution processing system according to the first aspect of the present invention comprises a plurality of hand held terminal devices for, in the case where watch information contents concerning a variety of clocks are distributed and information processed, acquiring and processing time information contents at the hand held terminal device, wherein a software watch is displayed as a video image by the hand held terminal device based on the watch information contents, and a time is clocked.

With this configuration, a plurality of software watches with different designs can be configured according to the information user's preference. Moreover, in the case where these software watches are used, a physical replacement of the real wristwatch or the like of the conventional system can be eliminated, and one does not wear the watch directory unlike the conventional system. Thus, the watch does not block manual work, and is not damaged, and one does not feel discomfort caused by sweat.

An information distribution apparatus according to the present invention comprises a transmission section that distributes time information contents concerning a variety of clocks as data so as to transmit a carrier signal having constructed and inserted therein a group of data rows of the watch information contents to the information user's hand held terminal device.

With this configuration, at the information user's hand held terminal device, a group of data rows is received in batch within a predetermined period, and the received data rows can be stored in batch in a storage device or the like. Therefore, after receiving the watch information contents, the information user freely reads out the watch information contents concerning a variety of clocks in an unreal time (asynchronously) by the hand held terminal device, thereby making it possible to configure a software watch such as brand watch or fashion watch.

The hand held terminal device according to the first aspect of the present invention reads out watch information contents asynchronously according to the information user's information operation in the case where the watch information contents concerning a variety of clocks are acquired and processed, and displays at least a software watch as a video image based on the watch information contents.

With this configuration, after receiving the watch information contents, the information user can configure a software watch such as brand watch or fashion watch by freely combining the watch information contents concerning a variety of clocks in an unreal time (asynchronously). Moreover, the information user can select one software watch from among many types of software watches by a simple information operation. Thus, one can use a preferable software watch according to the time, the place and the occasion, and can enjoy the software watch freely according to one's preference.

The information recording medium according to the present invention describes: watch information contents that contain video image information on plural types of clock character boards and time display software; and control procedures for clocking a time.

With this configuration, the watch information contents and control procedures can be provided for sale as package media by using the existing sales infrastructure. Moreover, the information user mounts an information recording medium on a hand held terminal device, and freely combines the watch information contents concerning a variety of clocks, thereby making it possible to construct a software watch such as brand watch or fashion watch.

In the information processing method according to the first aspect of the present invention, the information provider creates watch information contents concerning a variety of clocks when processing the watch information contents concerning a variety of clocks, and distributes the watch information contents to the information user's hand held terminal device so as to display the software watch as a video image based on the watch information contents distributed as data and so as to clock a time.

With this configuration, a plurality of software watches with different designs can be used according to the information user's preference. Moreover, in the case where these software watches are used, physical replacement of the real wristwatch or the like in the conventional system can be eliminated, and one does not wear the watch around one's wrist directly unlike the conventional system. Thus, the watch does not block manual work or is not damaged, and one does not feel discomfort caused by sweat.

Although the user needs only one watch that can be used at the same time, if an attempt is made to own a plurality of watches according to the time, the place and the occasion, all the real watches must contain batteries in the conventional system. However, the watch according to the present invention does not require so many batteries, and is environmentally reasonable from the viewpoint of prevention of wasteful battery power consumption.

In the watch information content distribution processing system according to the second aspect of the present invention, in the case where the current time information concerning a software watch is distributed and information processed, each hand held terminal device with a communication function triggers correction startup information distributed as data, thereby starting up a time correction program so as to correct the time of the software watch based on the current time information.

With this configuration, the time of the software watch can be automatically adjusted to a reference time or the like precisely. Therefore, the convenience of the software watch is improved more remarkably.

The information distribution system according to the present invention comprises a time correcting/managing device that manages current time information so as to distribute at least correction startup information and current time information as data according to the information user's request.

With this configuration, the information user can make a time correcting operation at an arbitrary timing so that the time of the software watch can be automatically adjusted to a reference time or the like precisely by a very simple operation. Therefore, in the case of constructing a watch information content distribution processing system, a high precision reference clock device may be mounted on a time correcting/managing device, and there is no need to provide the clock device at individual hand held terminal devices. This improves the convenience of the software watch more remarkably and greatly contributes to reduction of the manufacturing cost of a hand held terminal device that handles a software watch.

The hand held terminal device according to the second aspect of the present invention makes a request for communication with a specific communication provider, and receives correction startup information and current time information from the communication provider. Then, the terminal device triggers this correction startup information, thereby starting up the time correction program so as to correct the time of the software watch based on the current time information.

With this configuration, one can make a time correcting operation at an arbitrary timing so as to automatically adjust the time of the software watch to a reference time or the like precisely by a very simple operation. Therefore, the convenience of the software watch is improved more remarkably.

Moreover, once an automatic time correction mode has been set, if power is supplied, there is no need to worry about such time correcting operation itself, and the convenience is further improved. In addition, an intermittent automatic time correction mode is set, whereby one can always recognize a maximum error of a software watch itself, and can keep the maximum error at or under a predetermined quantity, which makes one feel easiness. In particular, there is no need to mount a reference clock device with high precision, making it possible to reduce the manufacturing cost of a hand held terminal device that handles a software watch.

In the information processing method according to the second aspect of the present invention, when the current time concerning a software watch is information processed, the information provider manages the current time information. In addition, the information provider distributes at least correction startup information and current time information as data in the information user's hand held terminal device according to the information user's request. The information user triggers the correction startup information distributed as data, thereby starting up the time correction program so as to correct the time of the software watch based on the current time information.

With this configuration, the time of the software watch can be automatically adjusted to a reference time or the like precisely. Therefore, the convenience of the software watch is improved more remarkably.

The present invention is very suitably applied to a software watch that embodies a wristwatch with an owner specific design, a brand watch, or fashion watch and the like by displaying it as a video image.

Additional advantages and modifications will readily occur to those skilled in the art. Therefore, the invention in its broader aspect is not limited to the specific details and representative embodiments shown and described herein. Accordingly, various modifications may be made without departing from the spirit or scope of the general inventive concept as defined by the appended claims and their equivalents.

What is claimed is:

1. A system for distributing watch information and processing information, said system comprising:

a plurality of hand held terminal devices that maintain a current time, the plurality of hand held terminal devices configured to acquire and process the watch information, the watch information including a plurality of software watches, each of a different design;

an information distribution apparatus for distributing the watch information to the plurality of hand held terminal devices; and display means for displaying the watch information, including a user-selected software watch from the plurality of software watches, on at least one of the plurality of hand held terminal devices;

wherein the watch information is displayed on the display means of the plurality of hand held terminal devices as a video image that depicts at least the current time, and wherein, the information distribution apparatus distributes additional information comprising advertisement information to the plurality of hand held terminal devices at the same time as the watch information so that the additional information is displayed on a portion of the display means of the plurality of hand held terminal devices, and the advertisement information is displayed as an Internet banner depicting items for sale and is displayed with the watch information.

2. The system as claimed in claim 1, wherein the information distribution apparatus comprises:

a data inserting section for inserting the watch information into a carrier signal in a group of data rows; and a transmission section for transmitting the carrier signal to the plurality of hand held terminal devices.

3. The system as claimed in claim 1, wherein the watch information is distributed as data to the plurality of hand held terminal devices by using existing broadcast infrastructure and/or communication infrastructure.

4. The system as claimed in claim 1, wherein the watch information comprises at least video image information of a clock character board.

5. The system as claimed in claim 1, wherein the plurality of hand held terminal devices comprise:

an operating section operated to input operational information concerning the watch information;

a receiving section that receives the watch information;

a storage device that stores the watch information received by the receiving section; and a control unit that reads out the watch information from the storage device according to the operational information.

6. The system as claimed in claim 1, wherein the plurality of hand held terminal devices are hand held telephone sets that comprise:

a tuner that receives watch information from a broadcast station;

a storage device that stores the watch information received by the tuner;

a data processing section that reads out and processes the watch information stored in the storage device; and a hand held telephone function controlled by the data processing section.

7. The system as claimed in claim 1, wherein an information provider records the watch information in an information recording medium, and provides the watch information to a user, and wherein the user mounts the information recording medium on a hand held terminal device, to use the watch information via the recording medium.

8. The system as claimed in claim 1, wherein the watch information is associated with time information managed by the plurality of hand held terminal devices.

9. The system as claimed in claim 1, wherein time information provided by an information provider is distributed as data to a user, so that the user is able to correct the watch information managed by the plurality of hand held terminal devices based on the time information received from the information provider.

10. The system as claimed in claim 1, wherein the watch information is distributed in a regular or irregular updating period from an information provider to the plurality of hand held terminal devices by using a broadcast infrastructure so that the display means automatically displays a clock design based on the regular or irregular updating period.

11. The system as claimed in claim 1, wherein a video image associated with a season is automatically displayed on the display means of the plurality of hand held terminal devices.

12. The system as claimed in claim 1, wherein the plurality of hand held terminal devices are a foldable type, and an opening angle of the plurality of hand held terminal devices is adjusted according to a user's preference.

13. The system as claimed in claim 1, wherein short-distance wireless communication is made between at least two hand held terminal devices so as to obtain time synchronization.

14. An information processing method for processing watch information comprising the steps of:

preparing watch information, including a plurality of software watches, each of a different design;

distributing the watch information to a plurality of hand held terminal devices so that a user is able to display video images associated with a user-selected software watch from the plurality of software watches on a display means based on the watch information;

maintaining a current time in said terminal devices and displaying the current time on the display means distributing additional information including advertisement information to the plurality of hand held terminal devices at the same time as the watch information so as to display the additional information on a portion of the display means of the plurality of hand held terminal devices, wherein the advertisement information is displayed as an Internet banner depicting items for sale and is displayed with the watch information.

15. The information processing method as claimed in claim 14, wherein the user acquires the watch information, and creates a desired watch design based on the acquired watch information.

16. The information processing method as claimed in claim 14, wherein the watch information is distributed to the plurality of hand held terminal devices by using existing broadcast infrastructure and/or communication infrastructure.

17. The information processing method as claimed in claim 14, wherein the watch information is recorded in an information recording medium, and is provided to a user, and wherein the user mounts the information recording medium to a hand held terminal device to use the watch information via the recording medium.

18. The information processing method as claimed in claim 17, wherein the information recording medium is provided by using an existing sales infrastructure.

19. The information processing method as claimed in claim 14, wherein the watch information is associated with time information already managed by the plurality of hand held terminal devices.

20. The information processing method as claimed in claim 14, wherein time information provided by an information provider is distributed as data to the user so that the user is able to correct the watch information managed by the plurality of hand held terminal devices based on the time information received from the information provider.

21. The information processing method as claimed in claim 14, wherein the watch information is distributed in a regular or irregular updating period from an information provider to the plurality of hand held terminal devices by using a broadcast infrastructure so that a display means automatically displays a clock design based on the regular or irregular updating period.

22. The information processing method as claimed in claim 14, wherein a video image associated with a season is automatically displayed on a display means of the plurality of hand held terminal devices.

23. The information processing method as claimed in claim 14, wherein the plurality of hand held terminal devices are a foldable type, and an opening angle of the plurality of hand held terminal devices is adjusted according to the user's preference.

24. The information processing method as claimed in claim 14, wherein short-distance wireless communication is made between at least two hand held terminal devices so as to obtain time synchronization.

* * * * *